United States Patent [19]

Mehta et al.

[11] 4,390,613

[45] Jun. 28, 1983

[54] DIFFUSION TRANSFER PHOTOGRAPHIC SYSTEM UTILIZING SUBSTITUTED PHENYLMERCAPTOAZOLES

[75] Inventors: Avinash C. Mehta, Belmont; George H. Nawn, Westwood; Lloyd D. Taylor, Lexington, all of Mass.

[73] Assignee: Polaroid Corporation, Cambridge, Mass.

[21] Appl. No.: 222,502

[22] Filed: Jan. 5, 1981

[51] Int. Cl.[3] ..... G03D 1/48

[52] U.S. Cl. ..... 430/219; 430/240; 430/382; 430/445; 430/960

[58] Field of Search ..... 430/219, 240, 960, 382, 430/445, 544, 957

[56] References Cited

U.S. PATENT DOCUMENTS

| | | | |
|---|---|---|---|
| 2,725,290 | 11/1955 | Smith . | |
| 3,260,597 | 7/1966 | Weyerts et al. . | |
| 3,265,498 | 8/1966 | Rogers . | |
| 3,295,976 | 1/1967 | Abbott et al. . | |
| 3,377,166 | 4/1968 | Weyerts et al. . | |
| 3,698,898 | 10/1972 | Grasshoff et al. . | |
| 3,700,457 | 10/1972 | Youngquist | 430/957 |
| 4,009,029 | 2/1977 | Hammond et al. . | |
| 4,052,213 | 10/1977 | Credner et al. | 430/382 |
| 4,131,467 | 12/1978 | Bigelow . | |
| 4,286,054 | 8/1981 | Englemann et al. | 430/344 |

FOREIGN PATENT DOCUMENTS 2427183 6/1974 Fed. Rep. of Germany .

OTHER PUBLICATIONS

Research Disclosure, 7/74, p. 12.

*Primary Examiner*—John E. Kittle
*Assistant Examiner*—John L. Goodrow
*Attorney, Agent, or Firm*—Gaetano D. Maccarone

[57] ABSTRACT

There is disclosed a diffusion transfer photographic system wherein development of an exposed photosensitive element with an aqueous alkaline processing composition is effected in the presence of a compound represented by the formula.

wherein X represents the nonmetallic atoms necessary to form a nucleus which completes a 5- or 6-membered heterocyclic moiety on said structure including substituted rings and fused rings; R is H, an alkali metal or a group which is cleavable in a photographic aqueous alkaline processing composition; and $R_1$ is either a group which has a pKa of from about 7 to about 14 which is ionizable to an anion whereby the silver salt of the mercaptan (resulting from cleavage or ionization of —SR) is rendered more soluble in the pH range within which $R_1$ is ionized to an anion than it is below that pH range, or a precursor of such a group.

40 Claims, 2 Drawing Figures

DIFFUSION TRANSFER PHOTOGRAPHIC SYSTEM UTILIZING SUBSTITUTED PHENYLMERCAPTOAZOLES

BACKGROUND OF THE INVENTION

This application relates generally to photography and, more specifically, to diffusion transfer photographic systems including products and processes.

Diffusion transfer photographic systems wherein images are formed in color by the use of image dye-providing materials such as dye developers are well known in the art. Generally, multicolor transfer images are formed by processing an exposed multicolor photosensitive silver halide element with an aqueous alkaline processing composition distributed between two sheet-like elements, one of these elements including an image receiving layer. The processing composition is so applied and confined within and between the two sheet-like elements as not to contact or wet outer surfaces of the two superposed elements, thus providing a film unit whose external surfaces are dry. The processing composition preferably is distributed in viscous form from a pressure rupturable container.

It is known in the art to carry out development in the presence of development restrainers whereby development of exposed silver halide is continued for a period of time sufficient to form an imagewise distribution of diffusible unoxidized dye developers in undeveloped areas of the silver halide emulsion layer(s) with the unoxidized dye developers being transferred by diffusion to a superposed image receiving element and, after the predetermined development period, restraining further development of exposed silver halide by means of the development restrainer. See, for example, U.S. Pat. No. 3,265,498. Various development restrainers which are useful for such purposes are known including mercaptoazoles such as 1-phenyl-5-mercaptotetrazole. However, the use of such development restrainers is subject to certain limitations. For example, U.S. Pat. No. 3,260,597 discloses that mercaptoazole development restrainers or "arrestors", such as 1-phenyl-5-mercaptotetrazole, can not be used in the aqueous alkaline processing compositon in any appreciable amount because development of exposed silver halide will be stopped prematurely particularly in the outer blue and green sensitive emulsion layers of a multicolor system.

It is also known in the art to use blocked development restrainers which are designed to provide a timed release of a development restrainer during the development process. See, for example, U.S. Pat. No. 3,698,898 which discloses the use of quinone- or naphthoquinone-methide precursors which release a photographic reagent such as 1-phenyl-5-mercaptotetrazole in the presence of alkali; U.S. Pat. No. 4,009,029 which discloses a class of cyanoethyl-containing blocked development restrainers; German Offenlegungsschrift No. 2,427,183 which discloses various blocked development restrainers, and U.S. Pat. Nos. 3,260,597 and 3,265,498, referred to above, which disclose hydrolyzable blocked restrainers.

The use of phenylmercaptetrazole compounds which are substituted on the phenyl ring as development inhibitors in certain conventional photographic systems is also known. See, for example, Research Disclosure, July 1974, page 12, and U.S. Pat. No. 3,295,976.

SUMMARY OF THE INVENTION

The present application relates to a diffusion transfer photographic system wherein the development process is carried out in the presence of phenylmercaptoazoles which are substituted on the phenyl ring.

It is therefore an object of this invention to provide a novel diffusion transfer photographic system.

It is another object to provide a diffusion transfer photographic system wherein development of an exposed photosensitive element is carried out in the presence of phenylmercaptoazole compounds which are substituted on the phenyl ring.

It is a further object to provide such a diffusion transfer photographic system wherein the compounds utilized include a blocking group designed to provide a timed release of the substituted phenylmercaptoazoles during the development process.

Yet another object is to provide a diffusion transfer photographic process wherein the pH of the processing composition initially is substantially equal to or greater than the pKa of the substituent on the phenyl ring of the phenylmercaptoazole compound and subsequently, during development, the pH is lowered below the pKa.

Still another object is to provide a diffusion transfer photographic system wherein the substituted phenylmercaptoazole compounds may be incorporated in the aqueous alkaline processing composition.

A further object is to provide a diffusion transfer photographic system wherein the substituted phenylmercaptotetrazole compounds may be incorporated in the photosensitive element.

Yet another object is to provide a diffusion transfer photographic system wherein the photographic speed of one or more silver halide emulsions may be increased.

A still further object is to provide a diffusion transfer photographic system wherein fog development may be decreased.

Another object is to provide novel color diffusion transfer photographic products and process.

BRIEF SUMMARY OF THE INVENTION

These and other objects and advantages are accomplished in accordance with the invention by providing a diffusion transfer photographic system wherein development of an exposed photosensitive element with an aqueous alkaline processing composition is carried out in the presence of compounds which are represented by the formula

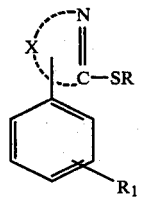

wherein X represents the nonmetallic atoms necessary to form a nucleus which completes a 5- or 6-membered heterocyclic moiety on said structure including substituted rings and fused rings; R is H, an alkali metal or a group which is cleavable in a photographic aqueous alkaline processing composition; and $R_1$ is either a group which has a pKa of from about 7 to about 14 which is ionizable to an anion, preferably about 8.5 or above, whereby the silver salt of the mercaptan (resulting from cleavage or ionization of —SR) is rendered more soluble in the pH range within which $R_1$ is ionized to an anion than it is below that pH range, or a precursor of such a group.

The compounds which are useful according to the invention are generally phenylmercaptoazoles wherein the substituted phenyl moiety is attached to either a nitrogen atom or a carbon atom of the azole moiety. Accordingly, the compounds may be represented by either of the following formulas which are both within generic Formula A.

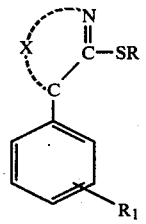

FORMULA B

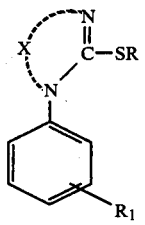

FORMULA C

The heterocyclic moieties formed by X preferably include those wherein the heterocyclic atoms (i.e., atoms other than carbon) are members of a single heterocyclic ring as contrasted with compounds containing fused or condensed heterocyclic rings in which the heterocyclic atoms are members of more than one heterocyclic ring. Typical suitable compounds include monoazoles such as benzoxazoles, benzothiazoles, etc.; diazoles such as benzimidazoles; triazoles such as 1,2,4-triazoles, etc.; tetrazoles and pyrimidines. In a preferred embodiment of the invention the compounds include a tetrazole nucleus.

The substituent ($R_1$) on the phenyl moiety may be either any suitable substituent which has a pKa of from about 7 to about 14 which is ionizable to an anion whereby the silver salt of the mercaptan (resulting from cleavage or ionization of —SR) is rendered more soluble in the pH range within which $R_1$ is ionized to an anion than it is below that pH range, or a precursor of such a substituent. Typical suitable substituents are:

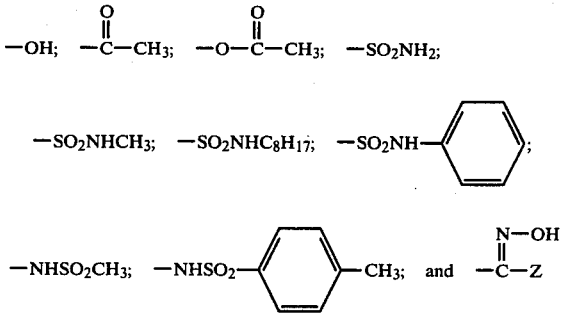

where Z is H, alkyl having from 1 to 10 carbon atoms, aralkyl such as benzyl or phenethyl, phenyl or substituted phenyl.

The compounds within generic formula A wherein $R_1$ is

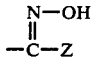

are novel compounds and are disclosed and claimed in our copending patent application Serial No. 222,543, filed on even date herewith.

As stated previously, the compounds may include a mercaptan group attached to a carbon atom of the azole nucleus or may include a blocking group attached to the sulfur atom with the blocking group designed to cleave from the molecule in an aqueous alkaline medium to provide a timed release of the desired phenylmercaptoazole compound. Where R is a blocking group it may be any suitable blocking group such as, for example, those which cleave by hydrolysis; those which cleave by quinone methide elimination (e.g., R is

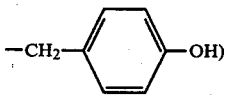

such as disclosed in U.S. Pat. No. 3,698,898; those which cleave by hydrolysis followed by quinone methide elimination (e.g., R is

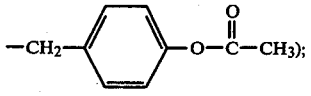

and those which cleave by β-elimination (e.g., R is

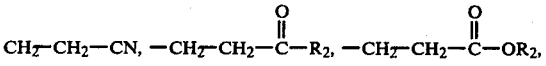

where $R_2$ is alkyl, and

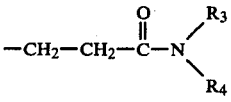

where $R_3$ and $R_4$ are H or alkyl). Typical suitable blocking groups include, for example,

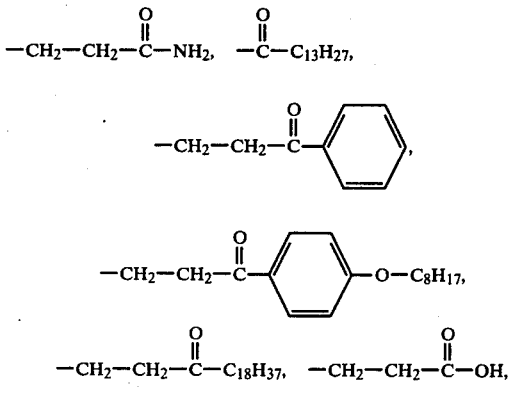

-continued $$-CH_2-CH_2-\overset{O}{\overset{\|}{C}}-O-CH_3,$$

and succinimido groups which are substituted on the nitrogen atom with alkyl or aryl as disclosed in U.S. Pat. No. 3,888,677.

In a preferred embodiment of the invention, R is $-CH_2-CH_2SO_2R_5$ where $R_5$ is alkyl, aryl or substituted aryl. Novel sulfone compounds within Formula A wherein R is $-CH_2-CH_2SO_2R_5$ and their use in photographic applications are disclosed and claimed in copending patent application Ser. No. 222,504 of James R. Bartels-Keith and Alan L. Borror, filed on even date herewith.

Cleavage of the blocking group in aqueous alkaline medium releases, in a timed fashion during development, the substituted phenylmercaptoazole moiety. Cleavage of the blocking group occurs according to the following reaction sequence:

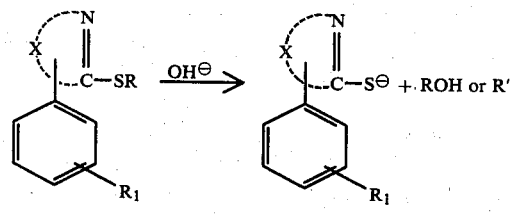

where R' is R minus a proton. The rate of release of the substituted phenylmercaptoazole moiety is temperature dependent, that is, more is released as the temperature at which processing of the film unit is effected rises. Thus, more of the substituted phenylmercaptoazole moiety is made available at elevated temperatures, i.e., above room temperature, where more is typically desired, less is released at room temperature and even less below room temperature where lesser amounts are needed. Thus, these blocked compounds which are utilized according to the invention provide more uniform sensitometry for the film units of the invention over a wide temperature range of processing. In other words, the sensitometry of the film units which include such blocked compounds according to the invention is less temperature dependent than would otherwise be the case.

The compounds which are useful according to the invention have been found to modify and/or control the sensitometry when present during diffusion transfer processing of an exposed photosensitive element, particularly when such processing is carried out at elevated temperatures, e.g., at about 95° F. Such modification and/or control include a speed increase for one or more of the silver halide emulsions in a multicolor diffusion transfer photographic system and/or an increase in the $D_{max}$ of one or more of the individual colors due to control of fog development, as will be illustrated in detail below herein. The advantageous results obtained through the use of the mercaptoazole compounds according to the invention are not completely understood. However, to further aid those skilled in the art to understand and practice the invention, the proposed theoretical mechanism by which the advantageous results are thought to be effected will be discussed here. It should be understood, however, that the diffusion transfer photographic system has been proved to be operative and highly effective through extensive experimentation and the proposed theoretical mechanism is not to be construed as being limiting of the invention. It is theorized that the results obtained according to the invention are due to the compounds performing different functions at different stages of the development process, that is, as weak silver solvents and promoters of development at one stage of the development process and as development inhibitors, or restrainers, at another stage of the development process, and that the duel functions of these compounds within the diffusion transfer photographic system are pH dependent.

It is well known that in the diffusion transfer photographic development process the pH of any particular location within the film unit varies with time. Typically, the processing composition employed in the process has a very high pH, e.g., from about 13–14, and during the development process each layer of the multilayer film unit goes through a broad pH range which includes very high pH levels and relatively low pH levels. When the pH is substantially equal to or above the pKa of the substituent $R_1$ on the phenyl ring, the dianion is formed, for example,

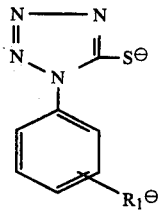

and acts as a weak silver solvent to form relatively soluble silver salts, thus promoting development. When the pH falls below the pKa of the substitutent $R_1$, the monoanion is formed, for example,

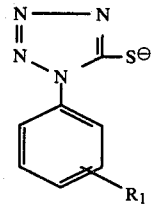

and the silver salt of the monoanion of the compound is very low in solubility resulting in a development restrainer action.

In the instances where certain substituted phenylmercaptotetrazole compounds were taught for use in specified photographic applications, i.e., the Research Disclosure article and U.S. Pat. No. 3,295,976, previously cited, the processes do not involve different pH at different stages of the development process. Thus, the pH-dependent dual functions of these compounds were not known or utilized in the processes disclosed in these references.

The compounds used according to the invention may be incorporated in various locations within the diffusion transfer film unit such as, for example, in the processing composition, in one or more layers within the photosensitive element or in one or more layers in the image-receiving element such as the image-receiving layer. In view of the foregoing discussion, it will be understood that, according to the invention, development of the exposed photosensitive element is carried out with a processing composition having an initial pH substantially equal to or above the pKa of $R_1$, at least for some period of time after the processing composition comes into contact with the mercaptoazole compound so as to enable the substituent to ionize to form the dianion. In addition, at some point during the development process the pH of the environment where the compound is located is reduced below the pKa of $R_1$ so as to form the monoanion.

BRIEF DESCRIPTION OF THE DRAWINGS

For a better understanding of the invention as well as other objects and further features thereof, reference is made to the following detailed description of various preferred embodiments thereof taken in conjunction with the accompanying drawings wherein.

DESCRIPTION OF THE PREFERRED EMBODIMENTS

Figure 1:
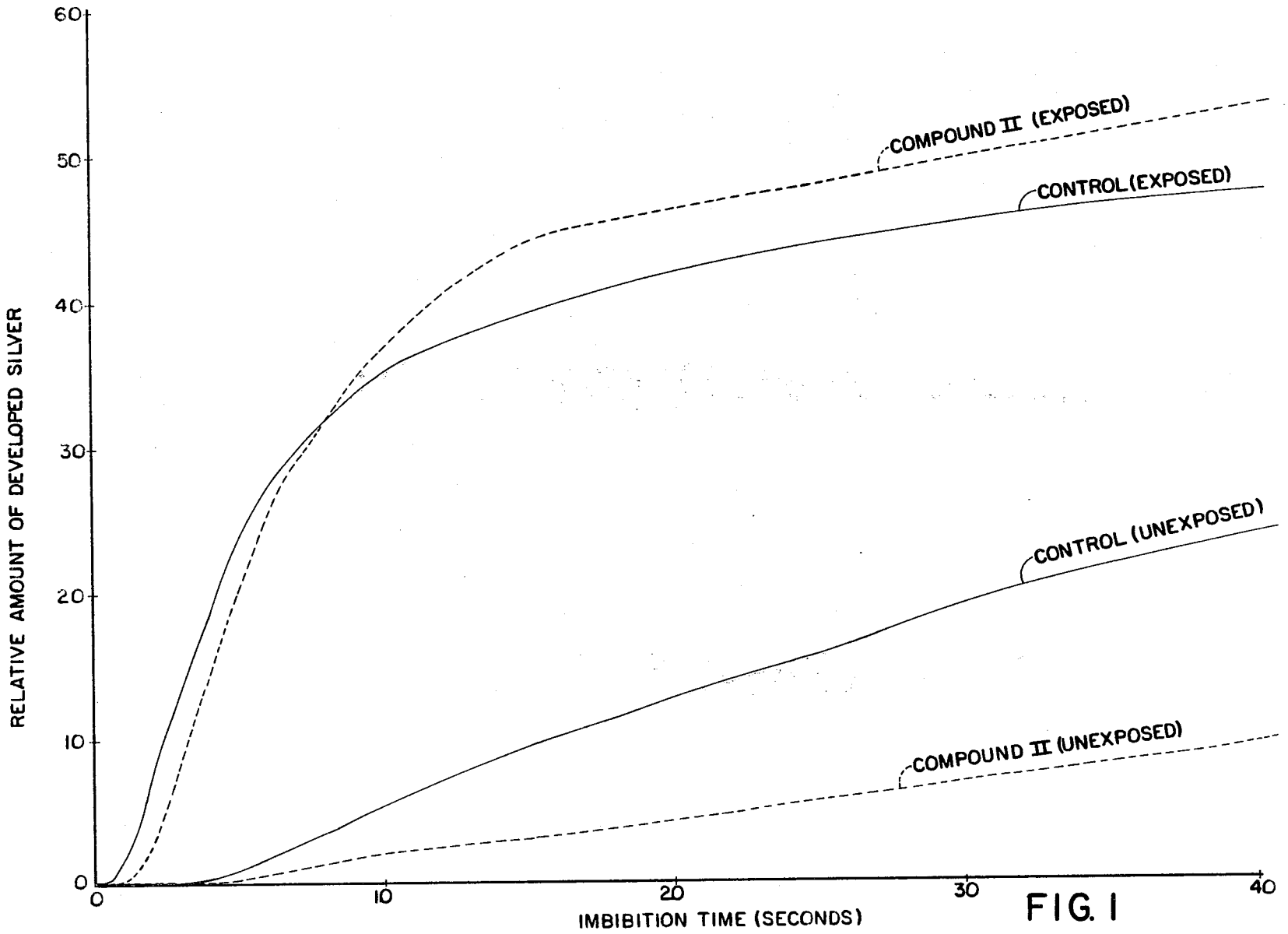
FIG. 1 is a graphical illustration of the relative amount of silver developed with respect to time in exposed and unexposed areas for a control film unit and a film unit according to the invention, both processed at room temperature.

The preferred compounds which are employed in accordance with the invention are represented by the formulas

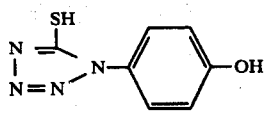
(I)

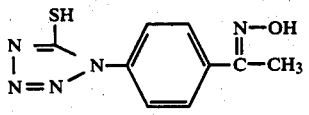
(II)

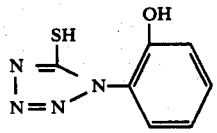
(III)

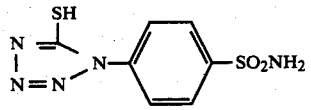
(IV)

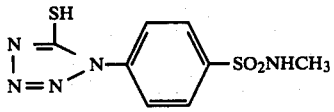
(V)

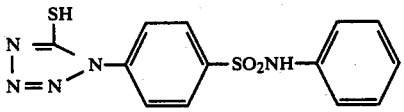
(VI)

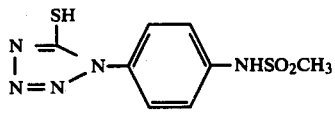
(VII)

-continued

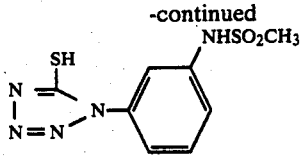
(VIII)

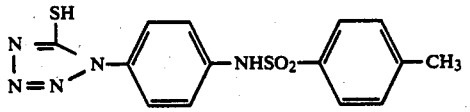
(IX)

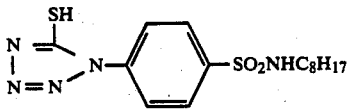
(X)

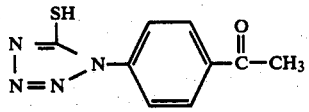
(XI)

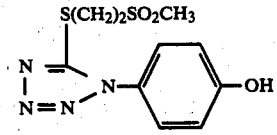
(XII)

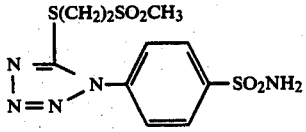
(XIII)

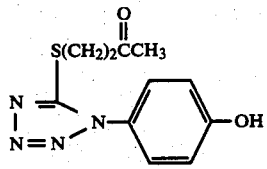
(XIV)

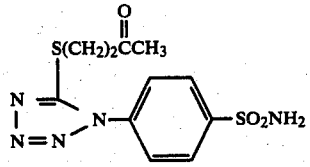
(XV)

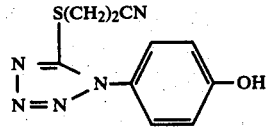
(XVI)

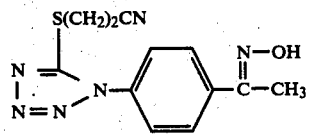
(XVII)

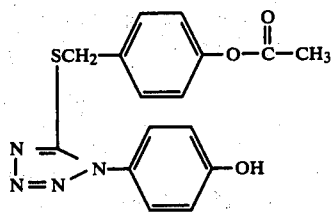
(XVIII)

-continued (XIX)

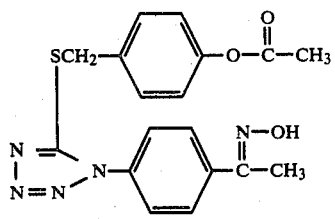

The mercaptoazole compounds which are useful according to the invention may be prepared by reactions which are well known in the art. For example, 2-mercaptoimidazoles can be prepared by the reactions disclosed in The Chemistry of Heterocyclic Compounds Vol. 6: Imidazole and Its Derivatives, Part I, Hofmann, Interscience Publishers, Inc., New York, 1953, pages 77–85; Mercaptothiazoles and mercaptobenzothiazoles can be prepared according to the methods disclosed in The Chemistry of Heterocyclic Compounds Vol. 34: Thiazole and Its Derivatives, Part I, Metzger, John Wiley and Sons, 1979, pages 260–269; Part 2, pages 370–377; benzoxazolethiones can be prepared according to the methods disclosed in Heterocyclic Compounds, Vol. 5, Elderfield, John Wiley and Sons, 1957, pages 439–444; 5-mercapto-1,3,4-oxadiazoles can be prepared according to the methods disclosed in Heterocyclic Compounds, Vol. 7, Elderfield, John Wiley and Sons, 1961, page 352; mercapto-1,3,4-thiadiazoles, ibid, pages 587–612; and tetrazoles by the techniques disclosed in Heterocyclic Compounds, Vol. 8, Elderfield, John Wiley and Sons, 1967, pages 1–107. Mercapto-1,2,4-triazoles can be prepared by known literature techniques as described, for example, in Jour. Chem. Soc. E. Haggarth 1163 (1949). The compounds within Formulas A, B and C where R is a blocking group can be prepared also by known reactions such as by preforming the monosodium salt of the appropriate mercaptoazole derivative and carrying out a condensation reaction with the appropriate blocking group in a solvent such as acetone, ethanol, acetonitrile, etc., or by reacting the mercaptoazole derivative with the appropriate blocking group in a suitable solvent in the presence of one equivalent of sodium bicarbonate. Alternatively, the appropriate mercaptoazole derivative can be formed and the blocking group attached by means of a Michael addition with an appropriate olefin such as $CH_2{=}CH{-}Y$ where Y is an electron withdrawing group such as cyano, etc., according to known teachings in the art.

The preparation of compound I is described in Pharmazie, 29(2), (1974), pp 95–99. The preparation of compound IV is described in Khim. Geterotsikl. Soedin., Sb.1: Azotsoderzhashchie Geterotsikl, 1967, pp 199–201. Compounds VI and VII can be prepared in accordance with the disclosure of U.S. Pat. No. 3,295,976.

Compound II is a per se novel compound and is one of the compounds claimed in our copending patent application, Ser. No. 222,543, filed on even date herewith. Compounds XII–XIX are per se novel compounds and are claimed in our copending patent application, Ser. No. 222,542, filed on even date herewith.

As stated previously, $R_1$ may also be a precursor of a substituent which has the requisite properties and the desired substituent may be formed in situ. For example, where it is desired to develop the exposed photosensitive element in the presence of a compound within Formula A which has a hydroxy group on the phenyl ring, it is possible to incorporate in the film unit as a precursor a compound within Formula A which has a hydrolyzable ester group on the phenyl ring and generate the desired hydroxy group in situ during photographic processing.

It should be noted here that the acetyl group which is substituted on the phenyl ring in compound XI does not ionize to any appreciable extent to form an anion in an aqueous alkaline photographic processing composition. However, it has been shown by experimentation that incorporating compound XI in a film unit according to the invention will provide advantageous results. Thus, it would appear that compound XI undergoes a change in aqueous alkaline processing composition and that the acetyl substituent is a precursor of a group which has the requisite properties described above which provide the desired results. It has also been found that when incorporated in the processing composition for a period of time, for example, about a week or more, prior to processing of the exposed photosensitive element, the compound does not provide the desired results, thus indicating that it has long term instability characteristics in the aqueous alkaline processing composition. It is therefore preferred to incorporate the compound elsewhere in the film unit, for example, in the photosensitive element.

Table I lists the pka of various substituents in certain of the compounds illustrated above.

TABLE I

| COMPOUND | pKa |
|---|---|
| I | 10.10 ± 0.1 |
| II | 11.4 |
| III | 9.50 ± 0.1 |
| IV | 9.95 ± 0.1 |
| V | 11.55 ± 0.1 |
| VI | 9.55 ± 0.1 |
| VII | 8.65 ± 0.1 |
| IX | 8.80 ± 0.1 |

Solubility product measurements were made for the silver salt of phenylmercaptotetrazole (PMT) at pH 13.5 and for the silver salt of compound II at pH 7 and pH 13.5 (above and below the pka of the oxime substituent). The results are listed in Table II.

TABLE II

| COMPOUND | pH | Ksp |
|---|---|---|
| PMT | 7 | $3 \times 10^{-16}$* |
| | 13.5 | $4 \times 10^{-16}$ |
| II | 7 | $\sim 1 \times 10^{-16}$ |
| | 13.5 | $2 \times 10^{-15}$ |

*Z. C. H. Tan, Photogr. Sci. Eng. 19, 17 (1975)

It is seen that while phenylmercaptotetrazole was relatively unaffected by pH the ionization of the oxime substituent increased the solubility of the silver salt of compound II by an order of magnitude.

The solubilities of the silver salts of PMT and compound II in the presence of excess amounts of their anions were measured at pH 7.0 and 13.5. Each solution was $4 \times 10^{-3}$ molar in silver. The results are shown in Table III wherein the solubility data is expressed in μmoles/liter of total silver.

TABLE III

| Molar Ratio | COMPOUND II pH | | PMT pH | |
|---|---|---|---|---|
| Compound/Ag | 7.0 | 13.5 | 7.0 | 13.5 |
| 1.25/1 | <1 | 19 | <1 | 1 |
| 1.75/1 | <1 | 44 | <1 | 2 |
| 2.13/1 | <1 | 93 | 1 | 4 |
| 2.5/1 | 2 | 140 | 3 | 8 |
| 4.5/1 | 2 | 320 | 15 | 18 |
| 7.5/1 | 5 | 1400 | 58 | 63 |

It can be seen that compound II is a weak to moderate silver solvent at high pH while PMT is not. Further, it is evident that when the oxime substituent is protonated it reverts to behavior which is similar to that of PMT. In fact, compound II forms an even less soluble salt in neutral solution than does PMT, thus giving it greater differentiation on the availability of silver in soluble form as the pH drops in the diffusion transfer development process.

As stated previously, the compounds which are employed according to the invention may be incorporated in any location in the film unit with the preferred location in any particular instance being dependent upon various factors such as the compound itself, the type of film unit and the results desired. The compounds generally may be incorporated in the film unit in any useful amount. Routine scoping tests may be used to ascertain the concentration appropriate for any given film unit and location. When the compounds are incorporated in the processing composition they are present preferably in an amount of from about 0.02 to about 0.07% by weight. When incorporated in a layer in the photosensitive element the compounds are typically present in a ratio of from about 1 mg/m$^2$ to about 3 mg/m$^2$ to about 3800 mg/m$^2$ of silver. It has been observed that, typically, where the compounds are incorporated in the photosensitive element, the total amount required per film unit to give a desired result is less than that required when the compound is incorporated in the processing composition. It has also been observed that too great an amount of the compounds can lead to reduced control of one or more of the image dye-providing materials which results in high $D_{min}$ values in the photographic reproduction or can lead to a loss in $D_{max}$ for one or more colors as will be apparent from the Examples.

In a preferred embodiment of the invention compounds according to the invention can be incorporated in more than one location in the diffusion transfer film unit. For example, part of the total quantity of the substituted phenylmercaptoazole compound can be incorporated in the processing composition and the remainder in the photosensitive element. Thus, during the initial stages of development, the quantity available can be appropriate to provide a speed increase for one or more silver halide emulsions (silver solvent effect) without providing any undesired premature development restraint and the additional quantity dissolved during processing could give a total concentration desired to prevent further development. This embodiment is particularly useful where R is H or an alkali metal for the compound incorporated in the processing composition and R is a cleavable group for the compound incorporated in the photosensitive element.

The compounds used in accordance with the invention may be used generally in association with any silver halide emulsion. It is preferred to use the compounds in a diffusion transfer photographic system which includes a negative silver halide emulsion, i.e., one which develops in the areas of exposure. The diffusion transfer photographic system of the invention may include any image dye-providing material in association with the silver halide emulsion(s).

The image dye-providing materials which can be utilized generally may be characterized as either (1) initially soluble or diffusible in the processing composition but which are selectively rendered nondiffusible imagewise as a function of development; or (2) initially insoluble or nondiffusible in the processing composition but which selectively provide a diffusible product imagewise as a function of development. The image dye-providing materials may be complete dyes or dye intermediates, e.g., color couplers. The requisite differential in mobility or solubility may be obtained, for example, by a chemical reaction such as a redox reaction, a coupling reaction or a cleavage reaction. In a particularly preferred embodiment of the invention the image dye-providing materials are dye developers which are initially diffusible materials. The dye developers contain, in the same molecule, both the chromophoric system of a dye and a silver halide developing function as is described in U.S. Pat. No. 2,983,606. Other image dye-providing materials which may be used include, for example, initially diffusible coupling dyes such as are useful in the diffusion transfer process described in U.S. Pat. No. 3,087,817 and which are rendered nondiffusible by coupling with the oxidation product of a color developer; initially nondiffusible dyes which release a diffusible dye following oxidation, sometimes referred to as "redox dye releaser" dyes, such as described in U.S. Pat. Nos. 3,725,062 and 4,076,529; initially nondiffusible image dye-providing materials which release a diffusible dye following oxidation and intramolecular ring closure as are described in U.S. Pat. No. 3,433,939 or undergo silver assisted cleavage to release a diffusible dye in accordance with the disclosure of U.S. Pat. No. 3,719,489; and initially nondiffusible image dye-providing materials which release a diffusible dye following coupling with an oxidized color developer as described in U.S. Pat. No. 3,227,550.

The compounds may be incorporated into the photographic elements by any suitable technique. In embodiments where the compounds are incorporated in a separate discrete layer or in a silver halide emulsion layer they are typically coated from a water dispersion and the layer includes a binder material such as gelatin or the like- The diffusion transfer film units of the invention include those wherein the image receiving element is designed to be separated from the photosensitive element after processing and integral positive-negative diffusion transfer film units which are retained intact after processing. In a preferred embodiment the diffusion transfer film units of the invention utilize initially diffusible dye developers as the image dye-providing materials. As described in U.S. Pat. No. 2,983,606, a photosensitive element containing a dye developer and a silver halide emulsion in photoexposed and a processing composition applied thereto, for example, by immersion, coating, spraying, flowing, etc., in the dark. The exposed photosensitive element is superposed prior to, during, or after the processing composition is applied, on a sheet-like support element which may be utilized as an image-receiving element. In a preferred embodiment, the processing composition is applied to the exposed photosensitive element in a substantially uniform layer as the photosensitive element is brought into superposed relationship with the image-receiving layer. The processing composition, positioned intermediate the photosensitive element and the image-receiving layer, permeates the emulsion to initiate development of the latent image contained therein. The dye developer is immobilized or precipitated in exposed areas as a consequence of the development of the latent image. This immobilization is apparently, at least in part, due to a change in the solubility characteristics of the dye developer upon oxidation and expecially as regards its solubility in alkaline solutions. It may also be due in part to a tanning effect on the emulsion by oxidized developing agent, and in part to a localized exhaustion of alkali as a result of development. In unexposed and partially exposed areas of the emulsion, the dye developer is unreacted and diffusible and thus provides an imagewise distribution of unoxidized dye developer, diffusible in the processing composition, as a function of the point-to-point degree of exposure of the silver halide emulsion. At least part of this imagewise distribution of unoxidized dye developer is transferred, by imbibition, to a superposed image-receiving layer or element, said transfer substantially excluding oxidized dye developer. The image-receiving layer receives a depthwise diffusion, from the developed emulsion, of unoxidized dye developer without appreciably disturbing the imagewise distribution thereof to provide a reversed or positive color image of the developed image. The image-receiving element may contain agents adapted to mordant or otherwise fix the diffused, unoxidized dye developer. In a preferred embodiment of said U.S. Pat. No. 2,983,606 and in certain commercial applications thereof, the desired positive image is revealed by separating the image-receiving layer from the photosensitive element at the end of a suitable imbibition period. Alternatively, as also disclosed in said U.S. Pat. No. 2,983,606, the image-receiving layer need not be separated from its superposed contact with the photosensitive element, subsequent to transfer image formation, if the support for the image-receiving layer, as well as any other layers intermediate said support and image-receiving layer, is transparent and a processing composition containing a substance, e.g., a white pigment, effective to mask the developed silver halide emulsion or emulsions is applied between the image-receiving layer and said silver halide emulsion or emulsions.

Dye developers, as noted in said U.S. Pat. No. 2,983,606, are compounds which contain, in the same molecule, both the chromophoric system of a dye and also a silver halide developing function. By "a silver halide developing function" is meant a grouping adapted to develop exposed silver halide. A preferred silver halide development function is a hydroquinonyl group. In general, the development function includes a benzonoid developing function, that is, an aromatic developing group which forms quinonoid or quinone substances when oxidized.

Multicolor images may be obtained using dye developers in diffusion transfer processes by several techniques. One such technique contemplates obtaining multicolor transfer images utilizing dye developers by employment of an integral multilayer photosensitive element, such as is disclosed in the aforementioned U.S. Pat. No. 2,983,606 and in U.S. Pat. No. 3,345,163, wherein at least two selectively sensitized photosensitive strata, superposed on a single support, are processed, simultaneously and without separation, with a single common image-receiving layer. A suitable arrangement of this type comprises a support carrying a red-sensitive silver halide emulsion stratum, a green-sensitive silver halide emulsion stratum and a blue-sensitive silver halide emulsion stratum, said emulsions having associated therewith, respectively, for example, a cyan dye developer, a magenta dye developer and a yellow dye developer. The dye developer may be utilized in the silver halide emulsion stratum, for example in the form of particles, or it may be disposed in a stratum behind the appropriate silver halide emulsion strata. Each set of silver halide emulsion and associated dye developer stata may be separated from other sets by suitable interlayers, for example, by a layer or stratum of gelatin or polyvinyl alcohol. In certain instances, it may be desirable to incorporate a yellow filter in front of the green-sensitive emulsion and such yellow filter may be incorporated in an interlayer. However, where desirable, a yellow dye developer of the appropriate spectral characteristics and present in a state capable of functioning as a yellow filter may be so employed and a separate yellow filter omitted.

Particularly useful products for obtaining multicolor dye developer images are disclosed in U.S. Pat. No. 3,415,644. This patent discloses photographic products wherein a photosensitive element and an image-receiving element are maintained in fixed relationship prior to exposure, and this relationship is maintained as a laminate after processing and image formation. In these products, the final image is viewed through a transparent (support) element against a light-reflecting, i.e., white background. Photoexposure is made through said transparent element and application of the processing composition provides a layer of light-reflecting material to provide a white background. The light-reflecting material (referred to in said patent as an "opacifying agent") is preferably titanium dioxide, and it also performs an opacifying function, i.e., it is effective to mask the developed silver halide emulsions so that the transfer image may be viewed without interference therefrom, and it also acts to protect the photoexposed silver halide emulsions from postexposure fogging by light passing through said transparent layer if the photoexposed film unit is removed from the camera before image-formation is completed.

U.S. Pat. No. 3,647,437 is concerned with improvements in products and processes disclosed in said U.S. Pat. No. 3,415,644, and discloses the provision of light-absorbing materials to permit such processes to be performed, outside of the camera in which photoexposure is effected, under much more intense ambient light conditions. A light-absorbing material or reagent, preferably a pH-sensitive phthalein dye, is provided so positioned and/or constituted as not to interfere with photoexposure but so positioned between the photoexposed silver halide emulsions and the transparent support during processing after photoexposure as to absorb light which otherwise might fog the photoexposed emulsions. Furthermore, the light-absorbing material is so positioned and/or constituted after processing as not to interfere with viewing the desired image shortly after said image has been formed. In the preferred embodiments, the light-absorbing material, also sometimes referred to as an optical filter agent, is initially contained in the processing composition together with a light-reflecting material, e.g., titanium dioxide. The concentration of the light-absorbing dye is selected to provide the light transmission opacity required to perform the particular process under the selected light conditions.

In a particularly useful embodiment, the light-absorbing dye is highly colored at the pH of the processing composition, e.g., 13–14, but is substantially non-absorbing of visible light at a lower pH, e.g., less than 10–12. This pH reduction may be effected by an acid-reacting reagent appropriately positioned in the film unit, e.g., in a layer between the transparent support and the image-receiving layer.

The dye developers are preferably selected for their ability to provide colors that are useful in carrying out subtractive color photography, that is, the previously mentioned cyan, magenta and yellow. The dye developers employed may be incorporated in the respective silver halide emulsion or, in the preferred embodiment, in a separate layer behind the respective silver halide emulsion, and such a layer of dye developer may be applied by use of a coating solution containing the respective dye developer distributed, in a concentration calculated to give the desired coverage of dye developer per unit area, in a film-forming natural, or synthetic, polymer, for example, gelatin, polyvinyl alcohol, and the like, adapted to be permeated by the processing composition.

Other diffusion transfer products and processes according to the invention are the types described in U.S. Pat. Nos. 3,573,043 and 3,594,165. For convenience, the entire disclosure of each of the six patents referred to immediately above is hereby incorporated by reference herein.

A particularly useful film unit according to the invention is one wherein the photosensitive element includes a light-reflecting layer between the silver halide layer and the image dye-providing layer (as described in Canadian Pat. No. 668,952), the substrate of the photosensitive element carries the polymeric acid neutralizing layer which in turn carries the timing layer (as described in U.S. Pat. No. 3,573,043) and the processing composition includes an oximated polydiacetone acrylamine thickening agent (as described in U.S. Pat. No. 4,202,694.

The invention will now be described further in detail with respect to specific preferred embodiments by way of examples, it being understood that these are illustrative only and the invention is not intended to be limited to the materials, conditions process parameters, etc. which are recited therein. All parts and percentages are by weight unless otherwise indicated.

EXAMPLE I

As a control a film unit was prepared as follows: The photosenstive element comprised a subcoated transparent polyethylene terephthalate photographic film base having coated thereon the following layers in succession:

1. a layer of sodium cellulose sulfate coated at a coverage of about 27.6 mgs/m$^2$;
2. a layer of a cyan dye developer represented by the formula

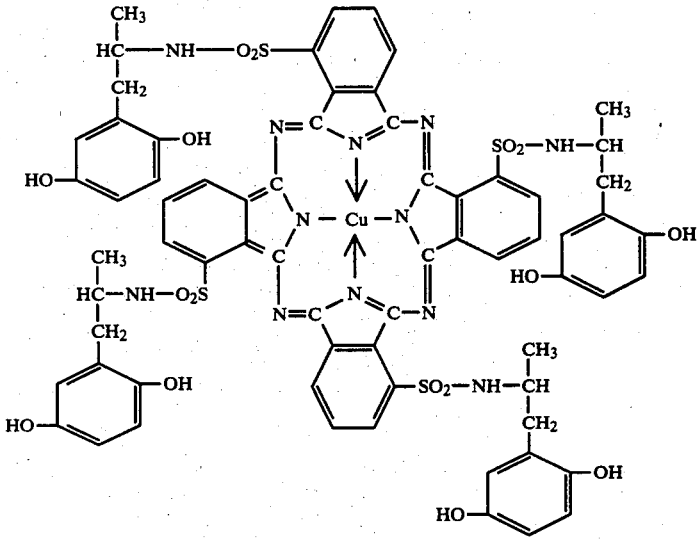

3. a red-sensitive silver iodobromide emulsion layer coated at a coverage of about 1280 mgs/m$^2$ of silver and about 768 mgs/m$^2$ of gelatin;
4. an interlayer comprising about 2505 mgs/m$^2$ of a 60-29-6-4-0.4 pentapolymer of butylacrylate, diacetone acrylamide, methacrylic acid, styrene and acrylic acid and about 78 mgs/m$^2$ of polyacrylamide;
5. A layer of a magenta dye developer represented by the formula

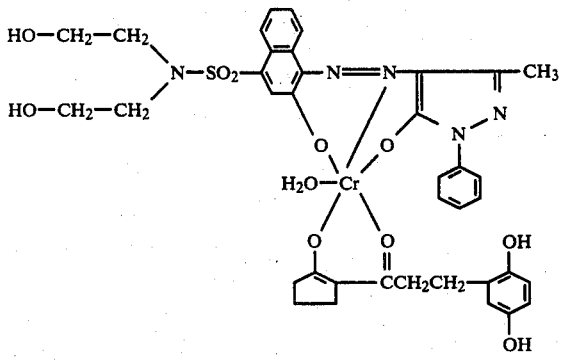

dispersed in gelatin and coated at a coverage of about 646 mgs/m$^2$ of the dye developer, about 448 mgs/m$^2$ of gelatin and including about 229 mgs/m$^2$ of 2-phenylbenzimidazole;

6. a green-sensitive silver iodobromide layer coated at a coverage of about 1050 mgs/m$^2$ of silver and about 504 mgs/m$^2$ of gelatin;

7. a layer comprising about 215 mgs/m$^2$ of dodecylamino-reductone and about 215 mgs/m$^2$ of gelatin;

8. an interlayer comprising about 1366 mgs/m$^2$ of the pentapolymer described in layer 4, about 87 mgs/m$^2$, about 78 mgs/m$^2$ of polyacrylamide and about 71 mgs/m$^2$ of succindialdehyde;

9. a layer of a yellow dye developer represented by the formula

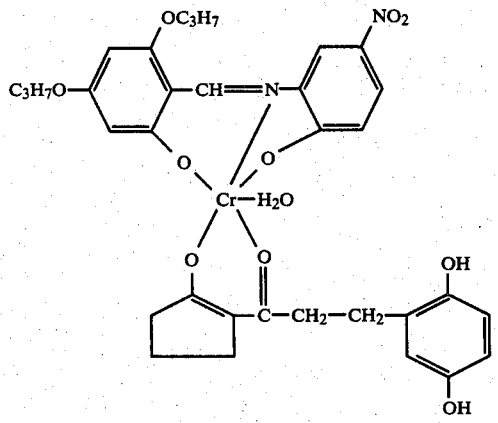

dispersed in gelatin and coated at a coverage of about 968 mgs/m$^2$ of dye developer and about 451 mgs/m$^2$ of gelatin and including about 208 mgs/m$^2$ of 2-phenylbenzimidazole;

10. a blue-sensitive silver iodobromide emulsion layer coated at a coverage of about 1280 mgs/m$^2$ of silver, about 775 mgs/m$^2$ of gelatin and about 306 mgs/m$^2$ of 4-methyl phenyl hydroquinone;

11. an overcoat layer coated at a coverage of about 461 mgs/m$^2$ of gelatin and about 21 mgs/m$^2$ of carbon black.

The image-receiving element comprised a transparent polyethylene terephthalate film base coated with the following layers in succession:

1. as a polymeric acid layer approximately 9 parts of a ½ butyl ester of polyethylene/maleic anhydride copolymer and 1 part of polyvinyl butyral coated at a coverage of about 2450 mgs/ft$^2$ (26,372 mgs/m$^2$);

2. a timing layer containing about 425 mgs/ft$^2$ (4575 mgs/m$^2$) of a 60-30-4-6 tetrapolymer of butyacrylate, diacetone acrylamide, styrene and methacrylic acid and including 9% polyvinyl alcohol; and 3. a polymeric image receiving layer of: (a) 3 parts of a mixture of 2 parts polyvinyl alcohol and 1 part poly-4-vinyl pyridine and (b) 1 part of a graft copolymer comprised of 4-vinylpyridine (4VP) and vinylbenzyl trimethyl ammonium chloride (TMQ) grafted onto hydroxyethyl cellulose (HEC) at a ratio of HEC/4VP/TMQ of 2.2/2.2/1 coated at a coverage of about 300 mgs/ft$^2$ (3229 mgs/m$^2$).

The film unit was processed with an aqueous alkaline processing composition as follows:

| | |
|---|---|
| Titanium dioxide | 38.05 g. |
| Carboxymethyl hydroxyethyl cellulose | 2.00 g |
| Potassium hydroxide (45% aqueous solution) | 11.11 g. |
| Benzotriazole | 0.28 g. |
| 6-methyl uracil | 0.30 g. |
| N—hydroxyethyl-N,N',N'—tris-carboxymethyl ethylene diamine | 0.75 g. |
| Polyethylene glycol (MW 4000) | 0.45 g. |
| Bis(2-aminoethyl)sulfide | 0.02 g. |
| Colloidal silica (30% aqueous dispersion) | 1.85 g. |
| N—phenethyl-α-picolinium bromide (50% aqueous solution) | 2.55 g. |
| 4-aminopyrazolo(3,4-d)pyrimidine | 0.25 g. |
| 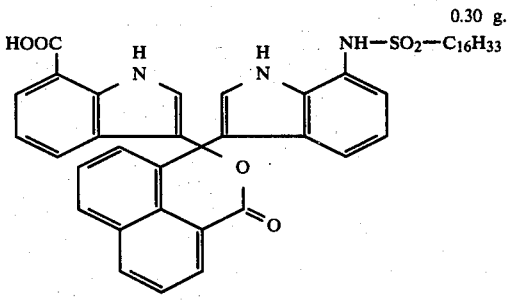 | 0.30 g. |
| 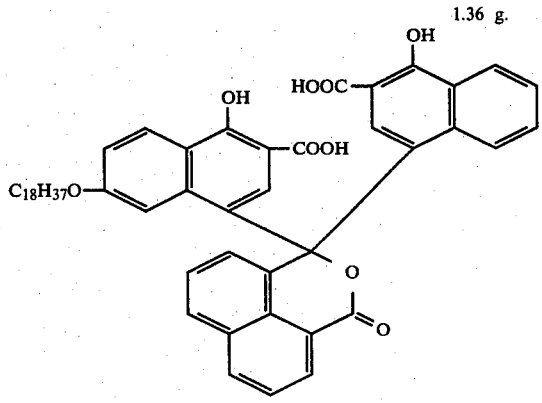 | 1.36 g. |
| Water to make a total of | 100. g. |

A film unit according to the invention was prepared identical to the control with the exception that the processing composition further included 0.05% of compound II.

The film units were processed at room temperature as follows: one half of each film unit was exposed through the transparent base of the image-receiving element to light from a Xenon source (100 meter candle seconds)

which was passed in turn through an ultraviolet filter, neutral density filters to reduce the film plane light flux to 0.5 m c s, and a Wratten 47B blue filter; the other half of each film unit was not exposed. The film units were then processed by passing them through a pair of rollers at a gap spacing of 0.0030" and the relative amount of silver developed (a function of the infra-red light absorbed) was measured as a function of time for both the exposed and unexposed areas. The relative amount of developed silver vs time curves are shown in FIG. 1. It is seen that the presence of compound II reduced fog development (relative amount of developed silver in unexposed areas) in comparison to the control. It is also apparent that the difference between the relative amount of silver developed in exposed and unexposed regions in the presence of compound II is signficantly greater than the corresponding difference for the control.

Figure 2:
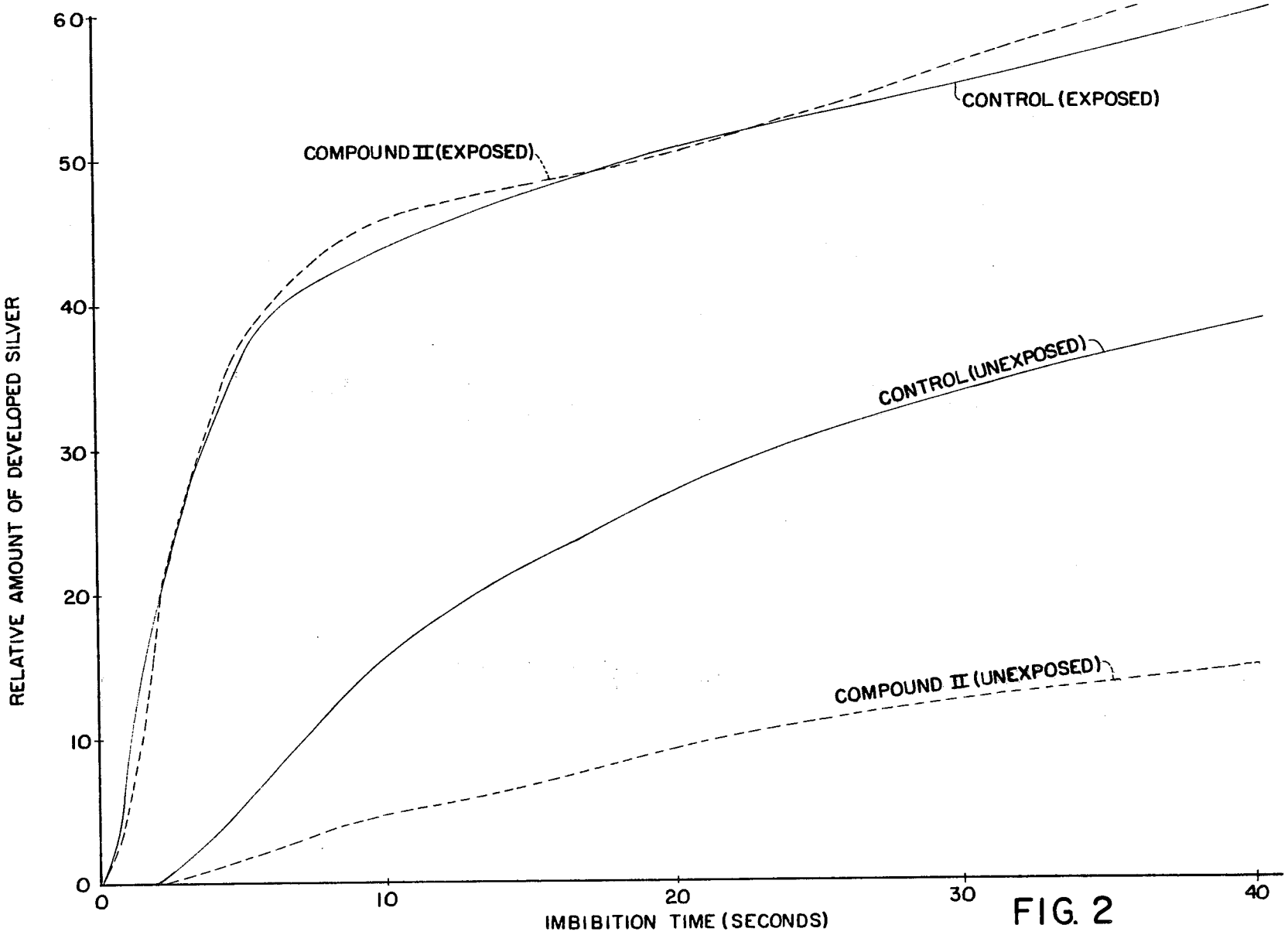
FIG. 2 is a similar graphical illustration for the same film units processed at 95° F.

The experiment was repeated with processing being carried out at 95° F. The relative amount of developed silver vs time curves as shown in FIG. 2. It is seen that fog development in the control increased significantly at the higher processing temperature, whereas the increase was only slight with compound II present. Further, at the higher processing temperature the presence of compound II greatly reduced fog development in comparison to the control without any appreciable change in the rate at which exposed silver halide was developed.

EXAMPLE II

As a control a film unit was prepared as follows: The photosensitive element comprised a subcoated opaque polyethylene terephthalate photographic film base having coated thereon the following layers in succession:

1. a cyan dye developer layer coated at a coverage of about 742 mgs/m$^2$ of the cyan dye developer described in Example I, about 1485 mgs/m$^2$ of gelatin, about 68 mgs/m$^2$ of 4'-methylphenylhydroquinone and about 270 mgs/m$^2$ of 2-phenylbenzimidazole;
2. a red-sensitive silver iodobromide emulsion layer coated at a coverage of about 1290 mgs/m$^2$ of silver and about 775 mgs/m$^2$ of gelatin;
3. an interlayer of a 60-30-4-6 terpolymer of butyl acrylate, diacetone acrylamide, styrene and methacrylic acid coated at a coverage of about 2582 mgs/m$^2$ of the tetrapolymer and about 68 mgs/m$^2$ of polyacrylamide;
4. a magenta dye developer layer coated at a coverage of about 646 mgs/m$^2$ of the magenta dye developer described in Example I, about 452 mgs/m$^2$ of gelatin, about 11 mgs/m$^2$ of carbon black and about 226 mgs/m$^2$ of 2-phenylbenzimidazole;
5. a green-sensitive silver iodobromide layer coated at a coverage of about 795 mgs/m$^2$ of silver and about 525 mgs/m$^2$ of gelatin;
6. an interlayer including about 1452 mgs/m$^2$ of the tetrapolymer described in layer 3, about 75 mgs/m$^2$ of polyacrylamide and about 71 mgs/m$^2$ of succindialdehyde;
7. a yellow dye developer layer coated at a coverage of about 968 mgs/m$^2$ of the yellow dye developer described in Example I, about 452 mgs/m$^2$ of gelatin, about 27 mgs/m$^2$ of carbon black and about 204 mgs/m$^2$ of 2-phenylbenzimidazole;
8. a blue-sensitive silver iodobromide emulsion layer coated at a coverage of about 1280 mgs/m$^2$ of silver, about 563 mgs/m$^2$ of gelatin and about 204 mgs/m$^2$ of 4'-methyl phenyl hydroquinone;
9. an overcoat layer coated at a coverage of about 484 mgs/m$^2$ of gelatin and about 43 mgs/m$^2$ of carbon black.

The image-receiving element was identical to that described in Example I.

The film unit was processed with a control aqueous alkaline processing composition which was the same as the control described in Example I with the exception that it included 0.55 g of benzotriazole and did not include any 4-aminopyrazolo (3,4-d)pyrimidine.

The film unit was exposed (0.5 meter-candle-seconds) on a sensitometer to a photographic test exposure scale, or step wedge, through the transparent support of the image-receiving element and processed at 75° F. with the processing composition by passing the film unit through a pair of pressure rollers set at a gap spacing of about 0.0030 inch. The film unit was retained intact and viewed through the transparent base. There was obtained a well developed image.

The neutral density column of the image was read on the densitometer to obtain the $D_{max}$ values for red, green and blue curves, respectively. In addition, the speed of the red, green and blue curves, respectively (defined as the negative log of the relative exposure required to give red, green and blue absorption in the neutral column a reflection density of 0.75) was measured. The values obtained are shown in Table IV.

The experiment was repeated with five additional film units (IIA-IIE) with the exception that the processing composition further included compound XI in the amounts shown in Table IV.

TABLE IV

| Film | % Comp'd | Dmax | | | Rel. Speed | | |
|---|---|---|---|---|---|---|---|
| Unit | XI | R | G | B | R | G | B |
| Control | — | 2.31 | 2.20 | 2.22 | 1.41 | 1.29 | 1.23 |
| IIA | 0.013 | 2.36 | 2.23 | 2.31 | 1.45 | 1.42 | 1.45 |
| IIB | 0.025 | 2.36 | 2.21 | 2.25 | 1.45 | 1.45 | 1.53 |
| IIC | 0.05 | 2.37 | 2.17 | 2.18 | 1.45 | 1.49 | 1.50 |
| IID | 0.075 | 2.36 | 2.18 | 2.24 | 1.43 | 1.45 | 1.27 |
| IIE | 0.1 | 2.34 | 2.16 | 2.23 | 1.40 | 1.33 | 0.44 |

It can be seen that the presence of compound XI provided a slight increase in the $D_{max}$ of the individual colors at certain concentrations and also provided an appreciable increase in the green and blue speeds at certain concentrations. Thus it is apparent that in this case about 0.025% of compound XI gave the optimum combination of speed increase and $D_{max}$ increase. The data also show that in a given film unit excessive concentrations of the compound for that film unit can lead to undesirable results; thus in Film Unit IIE the blue speed dropped considerably indicating premature inhibition of development of the blue-sensitive silver halide layer.

EXAMPLE III

The experiment described in Example II was repeated with six film units (IIIA–IIIF) which included compound II in the amounts shown in Table V. In addition, certain of the film units were also processed at 95° F. The room temperature data for the control film unit of Example II were used for comparison. In addition, a control film unit was processed at 95° F.

TABLE V

| Film Unit | % Comp'd II | R | G | B | R | G | B |
|---|---|---|---|---|---|---|---|
| | | 75° F. | | | | | |
| | | Dmax | | | Rel. Speed | | |
| Control | — | 2.31 | 2.20 | 2.22 | 1.41 | 1.29 | 1.23 |
| IIIA | 0.05 | 2.39 | 2.24 | 2.36 | 1.36 | 1.35 | 1.38 |
| IIIB | 0.06 | 2.43 | 2.28 | 2.38 | 1.39 | 1.40 | 1.44 |
| IIIC | 0.07 | 2.42 | 2.25 | 2.35 | 1.38 | 1.40 | 1.46 |
| IIID | 0.08 | 2.36 | 1.97 | 2.13 | 1.35 | 1.41 | 1.48 |
| IIIE | 0.09 | 2.35 | 1.91 | 2.04 | 1.40 | 1.48 | 1.55 |
| IIIF | 0.10 | 2.32 | 1.81 | 1.88 | 1.40 | 1.52 | 1.60 |
| | | 95° F. | | | | | |
| | | ΔDmax | | | ΔRel. Speed | | |
| Control | | −0.45 | −0.28 | −0.45 | +0.10 | +0.16 | +0.08 |
| IIIA | 0.05 | — | — | — | — | — | — |
| IIIB | 0.06 | −0.20 | −0.05 | −0.12 | +0.05 | +0.01 | −0.08 |
| IIIC | 0.07 | −0.17 | −0.02 | −0.10 | +0.04 | +0.01 | −0.08 |
| IIID | 0.08 | −0.13 | +0.26 | +0.12 | +0.07 | +0.02 | −0.06 |
| IIIE | 0.09 | −0.07 | +0.33 | +0.23 | +0.02 | −0.04 | −0.10 |
| IIIF | 0.10 | — | — | — | — | — | — |

The results show that at room temperature processing (75° F.) the presence of compound II provided an increase in the $D_{max}$ of the individual colors at concentrations up to 0.07% and an increase in the green and blue speeds in each film unit. When the film units were processed at 95° F. the presence of compound II provided a significant improvement over the control in $D_{max}$ since the $D_{max}$ of the individual colors went down considerably less, in comparison to the values obtained at 75° F., in most instances, and actually increased in others.

EXAMPLE IV

Two sets of film units, identical to those described in Example II except that the processing composition of one (IVA) contained 0.025% of compound XI and that of the other, (IVB) contained 0.05% of compound II were processed at 75° F. and 95° F. The data are shown in Table VI. The data for the control film unit of Example II were used for comparison.

TABLE VI

| Film Unit | R | G | B | R | G | B |
|---|---|---|---|---|---|---|
| | 75° F. | | | | | |
| | Dmax | | | Rel. Speed | | |
| Control | 2.31 | 2.20 | 2.22 | 1.41 | 1.29 | 1.23 |
| IVA | 2.36 | 2.21 | 2.25 | 1.45 | 1.45 | 1.53 |
| IVB | 2.27 | 2.22 | 2.26 | 1.39 | 1.39 | 1.42 |
| | 95° F. | | | | | |
| | ΔDmax | | | ΔRel. Speed | | |
| Control | −0.45 | −0.28 | −0.45 | +0.10 | +0.16 | +0.08 |
| IVA | −0.25 | +0.01 | −0.01 | +0.04 | −0.03 | −0.12 |
| IVB | −0.15 | −0.01 | +0.02 | +0.08 | +0.05 | −0.04 |

It can be seen that again the presence of compounds XI and II provided significant increases in the green and blue relative speeds at 75° F. and provided significant improvement in the red, green and blue $D_{max}$ at 95° F., with the relative speeds of these colors being desirably closer than in the control.

EXAMPLE V

A control film unit was prepared as follows: The photosensitive element comprised a subcoated opaque polyethylene terephthalate photographic film base having coated thereon in succession:

1. a layer of sodium cellulose sulfate coated at a coverage of about 14 mgs/m$^2$;

2. a cyan dye developer layer comprising about 747 mgs/m$^2$ of the cyan dye developer illustrated in Example I, about 1554 mgs/m$^2$ of gelatin, about 207 mgs/m$^2$ of 2-phenylbenzimidazole and about 68 mgs/m$^2$ of 4'-methyl phenyl hydroquinone;

3. a red-sensitive silver iodobromide emulsion layer coated at a coverage of about 1280 mgs/m$^2$ of silver and about 768 mgs/m$^2$ of gelatin;

4. an interlayer comprising about 1882 mgs/m$^2$ of the pentapolymer described in Example I and about 58 mgs/m$^2$ of polyacrylamide;

5. a magenta dye developer layer comprising about 545 mgs/m$^2$ of the magenta dye developer illustrated in Example I, about 382 mgs/m$^2$ of gelatin and about 230 mgs/m$^2$ of 2-phenylbenzimidazole;

6. a green-sensitive silver iodobromide emulsion layer coated at a coverage of about 560 mgs/m$^2$ of silver and about 246 mgs/m$^2$ of gelatin;

7. a green-sensitive silver iodobromide emulsion layer coated at a coverage of about 1050 mgs/m$^2$ of silver and about 504 mgs/m$^2$ of gelatin;

8. an interlayer comprising about 1598 mgs/m$^2$ of the pentapolymer described in Example I, about 102 mgs/m$^2$ of polyacrylamide and about 82.5 mgs/m$^2$ succindialdehyde;

9. a yellow dye developer layer comprising about 820 mgs/m$^2$ of the yellow dye developer illustrated in Example I, about 385 mgs/m$^2$ of gelatin and about 207 mgs/m$^2$ of 2-phenylbenzimidazole;

10. a blue-sensitive silver iodobromide emulsion layer coated at a coverage of about 1280 mgs/m$^2$ of silver, about 775 mgs/m$^2$ of gelatin and about 306 mgs/m$^2$ of 4'-methylphenyl hydroquinone; and 11. a topcoat layer of about 484 mgs/m$^2$ of gelatin.

The image-receiving element comprised a transparent subcoated polyethylene terephthalate film base on which the following layers were coated in succession:

1. as a polymeric acid layer approximately 9 parts of a ½ butyl ester of polyethylene/maleic anhydride copolymer and 1 part of polyvinyl butyral coated at a coverage of about 26,372 mgs/m$^2$;

2. a timing layer coated at a coverage of about 10,000 mgs/m$^2$ of a graft terpolymer of diacetone acrylamide, acrylamide, β-cyanoethylacrylate and 2-acrylamido-2-methane sulfonic acid on polyvinylalcohol;

3. a polymeric image receiving layer coated at a coverage of about 2200 mgs/m$^2$ of: (a) 3 parts of a mixture of 2 parts of polyvinyl alcohol and 1 part of poly-4-vinylpyridine and (b) 1 part of a graft copolymer comprised of 4-vinylpyridine (4VP) and vinyl benzyltrimethyl ammonium chloride (TMQ) grafted onto hydroxyethyl cellulose (HEC) at a ratio HEC/4VP/TMQ of 2.2/2.2/1; and about 74 mgs/m$^2$ of 1,4-butanediol diglycidyl ether;

4. a top coat layer comprising about 320 mgs/m$^2$ of polyvinyl alcohol.

The film unit was processed with the processing composition described in Example I as a control with the exception that it included 0.55 g of benzotriazole and 0.93 g of the aqueous colloidal silica dispersion.

Also four additional film units (VA-VD) were prepared and processed in the same manner with the exception that the processing composition further included compound I in the amounts shown in Table VII. An identical set of film units was also processed at 95° F.

TABLE VII

| Film Unit | % Comp'd I | R | G | B | R | G | B |
|---|---|---|---|---|---|---|---|
| | | 75° F. | | | | | |
| | | Dmax | | | Rel. Speed | | |
| Control | — | 1.63 | 1.87 | 2.04 | 1.61 | 1.49 | 1.40 |
| VA | 0.025 | 1.61 | 1.92 | 2.01 | 1.59 | 1.45 | 1.35 |
| VB | 0.05 | 1.58 | 1.95 | 2.15 | 1.57 | 1.45 | 1.37 |
| VC | 0.1 | 0.56 | 1.98 | 2.11 | 1.62 | 1.55 | 1.40 |
| VD | 0.2 | 1.40 | 1.82 | 1.89 | 1.64 | 1.58 | 1.43 |
| | | 95° F. | | | | | |
| | | ΔDmax | | | ΔRel. Speed | | |
| Control | — | −0.58 | −0.41 | −0.45 | 0.00 | −0.02 | −0.06 |
| VA | 0.025 | −0.39 | −0.33 | −0.27 | −0.06 | −0.03 | −0.05 |
| VB | 0.05 | −0.21 | −0.19 | −0.19 | −0.05 | −0.04 | −0.07 |
| VC | 0.1 | −0.09 | −0.21 | −0.09 | −0.10 | −0.10 | −0.03 |
| VD | 0.2 | −0.02 | −0.08 | +0.05 | −0.05 | +0.06 | +0.13 |

It can be seen that at room temperature processing the presence of compound I provided an increase in the green and blue $D_{max}$ at concentrations up to 0.1% without any appreciable loss in relative speed. At 95° F. processing the presence of compound I gave a much smaller loss in $D_{max}$ for red, green and blue in comparison to the control, again without any significant change in the relative speeds.

EXAMPLE VI

This experiment represents a comparison of compounds I and II and phenylmercaptotetrazole (PMT) with a control at room temperature.

The control film unit comprised a subcoated opaque film base having the following layers coated thereon in succession:

1. a layer of sodium cellulose sulfate coated at a coverage of about 100 mgs/m$^2$;

2. a cyan dye developer layer coated at a coverage of about 635 mgs/m$^2$ of the cyan dye developer described in Example I, about 430 mgs/m$^2$ of gelatin, about 237 mgs/m$^2$ of N-dodecylaminopurine and about 128 mgs/m$^2$ of 4'-methyl phenyl hydroquinone;

3. a red sensitive silver iodobromide emulsion layer coated at a coverage of about 1500 mgs/m$^2$ of silver and about 900 mgs/m$^2$ of gelatin;

4. an interlayer comprising about 1264 mgs/m$^2$ of the pentapolymer described in Example I and about 67 mgs/m$^2$ of polyacrylamide;

5. a magenta dye developer layer coated at a coverage of about 646 mgs/m$^2$ of a magenta dye developer represented by the formula

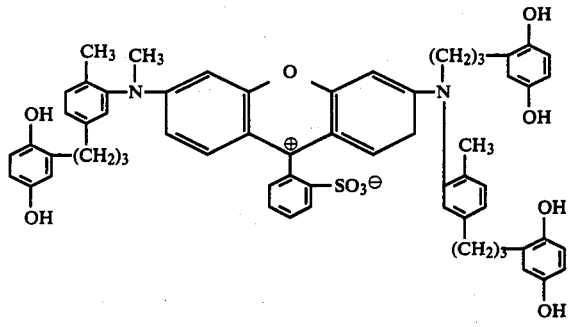

and about 323 mgs/m$^2$ of gelatin;

6. a green-sensitive silver iodobromide emulsion layer coated at a coverage of about 1300 mgs/m$^2$ of silver and about 596 mgs/m$^2$ of gelatin;

7. an interlayer comprising about 950 mgs/m$^2$ of the pentapolymer described in Example I and about 50 mgs/m$^2$ of polyacrylamide;

8. a yellow dye developer layer coated at a coverage of about 820 mgs/m$^2$ of the yellow dye developer described in Example I, and about 328 mgs/m$^2$ of gelatin;

9. a spacer layer comprising about 150 mgs/m$^2$ of N-dodecylaminopurine and about 150 mgs/m$^2$ of gelatin;

10. a blue sensitive silver iodobromide emulsion layer coated at a coverage of about 1200 mgs/m$^2$ of silver, about 421 mgs/m$^2$ of gelatin and about 320 mgs/m$^2$ of 4' methyl phenyl hydroquinone; and 11. a topcoat layer comprising about 484 mgs/m$^2$ of gelatin.

The image-receiving element comprises a transparent base having coated thereon in succession:

1. a polymeric acid layer as described in Example V.

2. a timing layer comprising about 2570 mgs/m$^2$ of the pentapolymer described in Example I and about 206 mgs/m$^2$ of polyacrylamide;

3. a polymeric image receiving layer as described in Example V with the exception that the coverages of the ether and the mixture of graft copolymer (PVA-P-4-VP) were 103 mgs/m$^2$ and 2990 mgs/m$^2$ respectively;

4. a topcoat layer comprising about 721 mgs/m$^2$ of a polyoxyethylene-polyoxypropylene block copolymer (Pluronic F-127, commercially available from BASF Wyandotte Co.) and about 309 mgs/m² of polyvinylalcohol.

The control film unit was processed with a processing composition as described in Example V.

Three additional film units (VIA–VIC) were prepared and processed in the same manner with the exception that the processing composition further included 0.05% of PMT, compound I and compound II respectively. The results are shown in Table VIII.

TABLE VIII

| Film | Dmax | | | Dmin | | | Rel. Speed | | |
|---|---|---|---|---|---|---|---|---|---|
| Unit | R | G | B | R | G | B | R | G | B |
| Control | 1.80 | 2.24 | 1.65 | 0.21 | 0.21 | 0.18 | 1.41 | 1.37 | 1.64 |
| VI A | 1.75 | 2.23 | 2.20 | 0.23 | 0.25 | 0.76 | 1.29 | 1.03 | * |
| VI B | 1.75 | 2.24 | 1.98 | 0.22 | 0.20 | 0.18 | 1.39 | 1.38 | 1.44 |
| VI C | 1.81 | 2.27 | 2.06 | 0.23 | 0.22 | 0.19 | 1.34 | 1.33 | 1.27 |

* blue relative speed too slow to measure

It is seen that the presence of PMT caused a large increase in the blue $D_{min}$ and a very large decrease in the blue speed, thus indicating that the PMT restrained development of the blue sensitive silver halide emulsion prematurely. The presence of compounds I and II provided an increase in the blue $D_{max}$ without any increase in the blue $D_{min}$.

EXAMPLE VII

As a control a film unit was prepared as follows: the photosensitive element comprised a subcoated transparent polyethylene terephthalate photographic film base having coated thereon the following layers in succession:

1. a layer of sodium cellulose sulfate coated at a coverage of about 14.4 mgs/m²;
2. a cyan dye developer layer comprising about 747 mgs/m² of the cyan dye developer illustrated in Example I, about 1554 mgs/m² of gelatin, about 270 mgs/m² of 2-phenylbenzimidazole and about 68 mgs/m² of 4'-methylphenylhydroquinone;
3. a red-sensitive silver iodobromide emulsion layer coated at a coverage of about 1280 mgs/m² of silver and about 768 mgs/m² of gelatin;
4. an interlayer comprising about 2505 mgs/m² of the pentapolymer described in Example I and about 78 mgs/m² of polyacrylamide;
5. a magenta dye developer layer comprsing about 646 mgs/m² of the magenta dye developer described in Example I, about 452 mgs/m² of gelatin and about 229 mgs/m² of 2-phenylbenzimidazole;
6. a green-sensitive silver iodobromide emulsion layer coated at a coverage of about 510 mgs/m² of silver and about 224 mgs/m² of gelatin;
7. a spacer layer comprising about 1045 mgs/m² of polymethylmethacrylate and about 55 mgs/m² of polyacrylamide;
8. a green-sensitive silver iodobromide emulsion layer coated at a coverage of about 700 mgs/m² of silver and about 336 mgs/m² of gelatin;
9. an interlayer comprising about 1366 mgs/m² of the pentapolymer described in Example I and about 87 mgs/m² of polyacrylamide;
10. a yellow dye developer layer comprising about 820 mgs/m² of the yellow dye developer illustrated in Example I, about 384 mgs/m² of gelatin and about 208 mgs/m² of 2-phenyl-benzimidazole;
11. a blue-sensitive silver iodobromide emulsion layer coated at a coverage of about 1280 mgs/m² of silver, about 775 mgs/m² of gelatin and about 306 mgs/m² of 4'-methylphenylhydroquinone;
12. a top coat layer of about 484 mgs/m² of gelatin.

The image receiving element was identical to that described in Example V. The film unit was processed with a processing composition as described in Example V.

Six additional film units were prepared (VIIA–VIIF). Film Units VIIA–VIIC further included 1 mg/m², 2 mgs/m² and 3 mgs/m², respectively, of compound II in layer 5 of the photosensitive element and Film Units VIID–VIIF further included 1 mg/m², 2 mgs/m² and 3 mgs/m² of compound XI in layer 5 of the photosensitive element. An identical set of film units was also processed at 95° F. The results are shown in Table IX.

TABLE IX

| Film | 75° F. | | | | | | 95° F. | | |
|---|---|---|---|---|---|---|---|---|---|
| | Dmax | | | Rel. Speed | | | Δ Dmax | | |
| Unit | R | G | B | R | G | B | R | G | B |
| Control | 1.95 | 1.67 | 2.23 | 1.50 | 1.49 | 1.32 | −0.56 | −0.20 | −0.18 |
| VIIA | 2.03 | 1.75 | 2.25 | 1.52 | 1.46 | 1.33 | −0.48 | −0.19 | −0.15 |
| VIIB | 2.09 | 1.70 | 2.24 | 1.47 | 1.46 | 1.33 | −0.27 | −0.09 | −0.11 |
| VIIC | 2.14 | 1.78 | 2.28 | 1.41 | 1.39 | 1.29 | −0.22 | −0.06 | −0.11 |
| VIID | 2.01 | 1.71 | 2.23 | 1.56 | 1.48 | 1.35 | −0.37 | −0.12 | −0.14 |
| VIIE | 2.04 | 1.73 | 2.25 | 1.58 | 1.46 | 1.37 | −0.27 | −0.05 | −0.11 |
| VIIF | 2.08 | 1.71 | 2.23 | 1.57 | 1.43 | 1.39 | −0.19 | +0.06 | −0.05 |

It can be seen that at room temperature the presence of compounds II and XI provided an increase in red and green $D_{max}$. At 95° F. processing the presence of compounds II and XI gave smaller losses (varying with the coverages) of red, blue and green $D_{max}$.

EXAMPLE VIII

PREPARATION OF COMPOUND XII

A catalyst was prepared by stirring a mixture of Celite® (10 g.) (diatomaceous earth available from Johns Manville) and potassium fluoride dihydrate (15 g.) in 250 ml. of distilled water for 30 minutes. The water was removed on a rotary evaporator and the solids dried overnight at room temperature under high vacuum. The catalyst was further dried in a vacuum oven at 58°–60° C. for about two days.

To a stirred solution of 1-(4-hydroxyphenyl)-5-mercaptotetrazole (5 g.) in dry tetrahydrofuran (50 ml.) at room temperature under nitrogen there were added methylvinylsulfone (2.8 g.) and the potassium fluoride/Celite catalyst (1 g.). The reaction mixture was stirred slowly for 24 hours. The solids were removed by filtration and the solvent was removed from the filtrate leaving behind a clear yellow-brown oil. The oil was dried under vacuum to give a tacky gum-like material.

Recrystallization from methanol followed by drying to constant weight under vacuum gave a white, solid, compound XII, m.p. 139°-141° C.

The NMR spectrum of the material was consistent with compound XII. $^{13}C$ NMR (dmso-$d_6$); δ159.28, 153.69, 126.28, 124.05, 116.23, 53.01, 40.59, 25.29 ppm.

EXAMPLE IX

PREPARATION OF COMPOUND XIII

To a suspension of compound IV (2.166 g, 8.43 mmol) in methanol (10 ml) there were added, under nitrogen, 78% methyl vinyl sulfone (1.44 g, 8.42 mmol) and 0.25 ml of 40% benzyl trimethyl ammonium hydroxide in methanol and the reaction mixture refluxed for twenty-four hours. The cooled reaction mixture was filtered to collect the white crystals which had formed. Thin layer chromatography showed that some starting materials were present. The desired product, compound XIII, was separated by column chromatography followed by removal of the solvent, crystallization on standing and drying. The structure of the product was confirmed by UV and $^{13}C$ NMR spectra.

EXAMPLE X

PREPARATION OF COMPOUND XIV

A catalyst was prepared by stirring a mixture of 10 g of Celite® (diatomaceous earth available from Johns Manville) and 15 g of potassium fluoride in 250 ml of distilled water for about 30 minutes, removing the water on a rotary evaporator at 56° C. and drying the solid under vacuum at 58°-60° C. to calculated weight, 196 g. The catalyst (1 g) was added to a stirred solution of 5 g of compound I and 1.8 g of methyl vinyl ketone in 50 ml of dry tetrahydrofuran and the suspension was stirred under nitrogen at room temperature for three days. The solids were removed by filtering and the solvent removed from the filtrate to give about 7 g of a brown-yellow oil which was stirred briefly with 70 ml of ether at room temperature. The ether solution was decanted from the brown oily solid which had deposited, and the crystalline solid which formed in the ether on standing collected by filtration, washed and dried to give 4 g of white crystals (compound XIV), m.p. 118°-120° C. The structure of the product was confirmed by a $^{13}C$ NMR spectrum.

EXAMPLE XI

PREPARATION OF COMPOUND XV

A mixture of compound IV (257 mg., 1.0 mmol), methyl vinyl ketone (0.081 ml, 1.0 mmol) and 200 mg of potassium fluoride on Celite catalyst (6 mmol/g) in about 2 ml of pyridine was stirred overnight. The reaction mixture was poured into 5% hydrochloric acid and the solid collected by filtration. Thin layer chromatography showed two compounds. The desired product (compound XV) was separated by column chromatography, followed by removal of the solvent, crystallization on standing and drying. The structure of the product was confirmed by a proton NMR spectrum.

EXAMPLE XII

PREPARATION OF COMPOUND XVI

A stirred mixture of compound I (30.0 g, 0.154 m), 3-bromopropionitrile (20.72 g, 0.154 m) and sodium bicarbonate (12.98 g, 0.154 m) in 600 ml of dry acetonitrile was heated under nitrogen at 55° C. for 42 hours, then cooled in an ice bath and vacuum filtered. The filtrate was evaporated on a rotary evaporator at 25° C. The syrupy residue was taken up in 500 ml of ethyl acetate, washed with 400 ml of saturated $NaHCO_3$ solution and twice with 200 ml of water, dried over sodium sulfate and adsorptive activated carbon, and vacuum filtered through diatomaceous earth. The filtrate was evaporated on a rotary evaporator at 25° C. and the crystalline residue was taken up in 200 ml of ethyl acetate and 100 ml of hexane added to the solution. The solution was stored in a refrigerator overnight and 50 ml of hexane added. The crystalline material was collected by filtration, washed with two 50 ml volumes of hexane and dried under reduced pressure at ambient temperature to give 25 g (65.7% yield) of compound XVI.

EXAMPLE XIII

PREPARATION OF COMPOUND XVII

A mixture of compound II (11.647 g, 49.58 mmol), β-bromopropionitrile (6.626 g, 49.58 mmol) and sodium bicarbonate (4.17 g, 49.58 mmol) in 200 ml of dry acetonitrile was magnetically stirred in a 55° C. bath under nitrogen overnight. The reaction mixture was vacuum filtered and the filtrate was stripped of solvent by rotary evaporation giving an orange oily residue. The residue was taken up in ethyl acetate (75 ml) and to the solution there were added seed crystals and 150 ml of hexane. The mixture was scratched and stored overnight in a refrigerator. The crystals which formed were collected by filtration, washed twice with hexane and dried to give 12.74 g of compound XVII as light yellow crystals, in p. 111°-113° C. The structure of the product was confirmed by IR, UV and NMR spectra and thin layer chromatography.

EXAMPLE XII

PREPARATION OF COMPOUND XVIII

A mixture of compound I (4.14 g, 21.3 mmol), p-acetoxybenzyl chloride (3.94 g, 21.3 mmol) and sodium bicarbonate (1.79 g, 21.3 mmol) in 130 ml of dry acetonitrile was magnetically stirred under dry nitrogen at 55° C. overnight. The reaction mixture was cooled in an ice bath, the solids removed by vacuum filtration and the solvent stripped from the filtrate to give an oily residue. The oily residue was taken up in 100 ml. of ethyl acetate, washed with 80 ml of saturated sodium bicarbonate and twice with 80 ml of water, dried over sodium sulfate and activated charcoal and the mixture vacuum filtered through diatomaceous earth to give a light yellow solution. The solvent was stripped from the solution by rotary evaporation to give 12.5 g. of a light yellow oil. The oil was taken up in a mixture of 20 ml of ethyl acetate and 80 ml of hexane and the solution allowed to stand in a refrigerator overnight. The solvent was stripped by rotary evaporation to give an oily residue which was taken up in 100 ml of hexane and allowed to stand. The crystals which formed were collected by filtration, recrystallized from a mixture of 100 ml of hexane and 10 ml of ethyl acetate, washed with 20 ml of hexane and dried to give 6.17 g of the desired product (compound XVIII), m.p. 153°-154° C. (84.6% yield). The structure of the product was confirmed by IR, UV and NMR spectra and thin layer chromatography.

EXAMPLE XV

As a control a film unit was prepared as follows: the negative element comprised an opaque subcoated polyethylene terephthalate film base on which the following layers were coated in succession.

1. as a polymeric acid layer approximately 9 parts of a ½ butyl ester of polyethylene/maleic anhydride copolymer and 1 part of polyvinyl butyral coated at a coverage of about 26,460 mgs./m.$^2$;

2. a timing layer comprising about 97% of a 60-29-6-4-0.4 pentapolymer of butylacrylate, diacetone acrylamide, methacrylic acid, styrene and acrylic acid and about 3% polyvinylalcohol coated at a coverage of about 3000 mgs./m.$^2$;

3. a cyan dye developer layer comprising about 511 mgs./m.$^2$ of the cyan dye developer described in Example I, about 70 mgs./m.$^2$ of 4'methyl phenyl hydroquinone and about 317 mgs./m.$^2$ of gelatin;

4. a red-sensitive silver iodobromide emulsion layer comprising about 1378 mgs./m.$^2$ of silver and about 827 mgs./m.$^2$ of gelatin;

5. an interlayer comprising about 2090 mgs./m.$^2$ of the pentapolymer described in layer 2, about 110 mgs./m.$^2$ of polyacrylamide and about 44 mgs./m.$^2$ of succinaldehyde;

6. a magenta dye developer layer comprising about 460 mgs./m$^2$ of a magenta dye developer represented by the formula

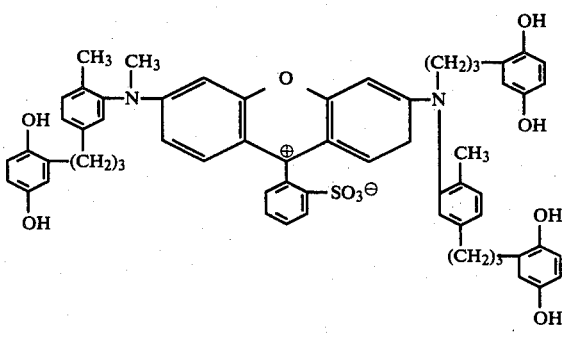

and about 210 mgs./m$^2$ of gelatin;

7. a green-sensitive silver iodobromide emulsion layer comprising about 723 mgs./m.$^2$ of silver and about 318 mgs./m.$^2$ of gelatin;

8. an interlayer comprising about 1881 mgs./m.$^2$ of the pentapolymer described in layer 2 and about 99 mgs./m.$^2$ of polyacrylamide;

9. a yellow dye developer layer comprising about 689 mgs./m.$^2$ of the yellow dye developer described in Example I and about 276 mgs./m.$^2$ of gelatin;

10. a blue-sensitive silver iodobromide emulsion layer comprising about 764 mgs./m.$^2$ of silver, about 499 mgs./m.$^2$ of gelatin, and about 265 mgs./m.$^2$ of 4'-methyl phenyl hydroquinone; and 11. a topcoat layer of about 400 mgs./m.$^2$ of gelatin.

The image receiving element comprised a transparent subcoated polyethylene terephthalate film base upon which there was coated an image receiving layer coated at a coverage of about 300 mgs./ft.$^2$ (3229 mgs./m$^2$) of: (a) 3 parts of a mixture of 2 parts polyvinyl alcohol and 1 part poly-4-vinylpyridine and (b) 1 part of a graft copolymer comprised of 4-vinylpyridine (4VP) and vinyl benzyl trimethyl ammonium chloride (TMQ) grafted onto hydroxyethyl cellulose (HEC) at a ratio HEC/4VP/TMQ of 2.2/2.2/1; and about 5 mgs./ft.$^2$ (53.8 mgs./m.$^2$ of 1,4-butanediol diglycidyl ether.

The film unit was processed with a processing composition made up as follows:

| | | |
|---|---|---|
| Water | 1632 | ml. |
| $TiO_2$ | 2312.0 | grams |
| Oximated polydiacetoneacrylamide | 32.0 | " |
| Potassium hydroxide (45% solution) | 468.0 | " |
| Benzotriazole | 22.0 | " |
| 4-aminopyrazole-(3,4-d)pyrimidine | 10.0 | " |
| 6-methyl uracil | 12.0 | " |
| N—hydroxyethyl-N,N',N'—triscarboxymethyl ethylene diamine | 30.0 | " |
| Polyethylene glycol (M.W. 4000) | 18.0 | " |
| Bis(20 aminoethyl)sulfide | 0.8 | " |
| Colloidal silica (30% solids) | 37.0 | " |
| N—phenethyl-α-picolinium bromide (50% solids) | 102.0 | " |
| Allopurinol | 3.3 | " |
| 2-methyl imidazole | 23.8 | " |
| 6-methyl-5-bromo azabenzimidazole | 4.8 | " |
| 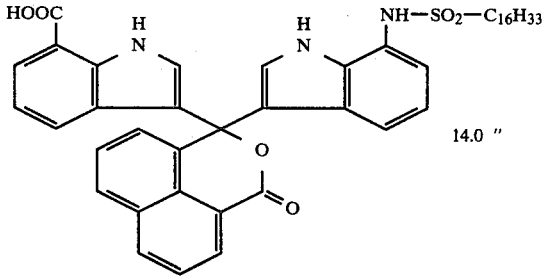 | 14.0 | " |
| 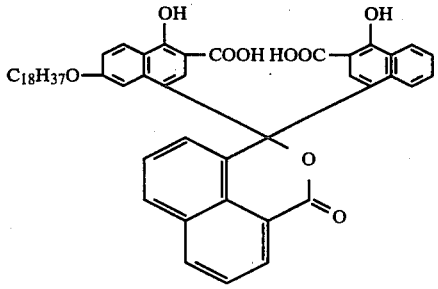 | 62.3 | " |

The negative element was exposed (2 meter-candleseconds) on a sensitometer to a test exposure scale with white light, and then brought together with the image receiving element and processed at room temperature (24° C.) by passing the film unit through a pair of rollers set at a gap spacing of about 0.0026 inch. The film unit was kept intact and viewed through the base of the image receiving element.

An identical film unit was processed in the same manner at 35° C. The neutral density columns of the images were read on a densitometer to obtain the Dmax and Dmin values for red, green and blue, respectively. The values obtained are shown in Table IX.

Seven additional film units according to the invention (VIIIA–VIIIG) were prepared. These were identical to the control with the exception that the negatives also included a top coat layer comprising about 20 mg./ft.$^2$ (215 mgs./m.$^2$) of a blocked compound according to the invention (as shown in Table IX) and about 20 mg./ft.$^2$ of gelatin. The film units were processed as described above at 24° C. and at 35° C. The results are shown in Table X.

TABLE X

| Film Unit | Compound | Dmax R | Dmax G | Dmax B | Dmin R | Dmin G | Dmin B |
|---|---|---|---|---|---|---|---|
| | | | | 24° C. | | | |
| Control | | 1.81 | 1.60 | 1.31 | 0.15 | 0.16 | 0.24 |
| VIIIA | XII | 1.60 | 1.48 | 1.40 | 0.18 | 0.17 | 0.24 |
| VIIIB | XIII | 1.33 | 1.43 | 1.41 | 0.15 | 0.16 | 0.23 |
| VIIIC | XIV | 1.68 | 1.74 | 1.91 | 0.16 | 0.17 | 0.26 |
| VIIID | XV | 1.44 | 1.39 | 1.37 | 0.16 | 0.13 | 0.16 |
| VIIIE | XVI | 1.30 | 1.42 | 1.46 | 0.15 | 0.13 | 0.15 |
| VIIIF | XVII | 1.58 | 1.65 | 1.64 | 0.16 | 0.13 | 0.15 |
| VIIIG | XVIII | 1.48 | 1.83 | 1.88 | 0.14 | 0.15 | 0.23 |
| | | | | 35° C. | | | |
| Control | — | 1.43 | 1.20 | 0.95 | 0.16 | 0.17 | 0.25 |
| VIIIA | XII | 1.32 | 1.23 | 1.12 | 0.16 | 0.17 | 0.24 |
| VIIIB | XIII | 1.07 | 1.13 | 1.11 | 0.16 | 0.17 | 0.25 |
| VIIIC | XIV | 1.65 | 1.67 | 1.62 | 0.16 | 0.17 | 0.26 |
| VIIID | XV | 1.28 | 1.24 | 1.14 | 0.16 | 0.14 | 0.17 |
| VIIIE | XVI | 1.24 | 1.27 | 1.24 | 0.17 | 0.14 | 0.17 |
| VIIIF | XVII | 1.40 | 1.35 | 1.34 | 0.16 | 0.14 | 0.17 |
| VIIIG | XVIII | 1.67 | 1.78 | 1.61 | 0.14 | 0.15 | 0.25 |

It is seen that at both 24° C. and 35° C. the blue $D_{max}$ of Film Units VIIIA–VIIIG is higher than that of the Control and, in some instances much higher. At 24° C. the green $D_{max}$ of Film Units VIIC, VIIF and VIIG is higher than that of the Control while at 35° C. the green $D_{max}$ of all the Film Units except VIIIB is higher.

EXAMPLE XVI

PREPARATION OF COMPOUND XIX

A mixture of compound II (1.175 g, 5 mmol), sodium bicarbonate (420 mg., 5 mmol) and p-acetoxybenzyl chloride (925 mg., 5 mmol) in 30 ml of acetone was heated to boiling on a steam bath for 24 hours. The solution was vacuum filtered and the solvent was removed from the filtrate by rotary evaporation at 25° C. to give a light yellow oil. The oil was taken up in 30 ml. of methanol, the solution vacuum filtered and the filtrate allowed to stand overnight in a refrigerator. The light yellow crystals which formed were collected by filtration and dried under reduced pressure at room temperature to give 1.34 g (70% yield) of compound XIX, m.p. 126°–127° C.

$C_{18}H_{17}N_5O_3S$ requires 56.38% C, 4.47% H, 18.27% N and 8.36% S. Elemental analysis found 56.50% C, 4.57% H, 18.27% N and 8.12% S.

Although the invention has been described with respect to specific preferred embodiments, it is not intended to be limited thereto but rather those skilled in the art will recognize that variations and modifications may be made within the spirit of the invention and the scope of the appended claims.

What is claimed is:

1. A photographic product for use in forming a diffusion transfer photographic image comprising a photosensitive element comprising a support carrying at least one silver halide emulsion layer having associated therewith an image dye-providing material, a second sheet-like element positioned in superposed or superposable relationship with said photosensitive element, an image receiving layer positioned in one of said elements, means for lowering the pH of an aqueous alkaline processing composition positioned in one of said elements, a rupturable container releasably holding an aqueous alkaline processing composition adapted, when distributed between a pair of predetermined layers carried by said photosensitive element and said second element, to develop said silver halide emulsion and provide a diffusion transfer image on said image receiving layer, said product including at least one compound represented by the formula

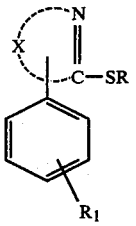

wherein X represents the nonmetallic atoms necessary to form a nucleus which completes a 5- or 6-membered heterocyclic moiety on said structure, R is H, an alkali metal or an group which is cleavable in said aqueous alkaline processing composition and $R_1$ is either a group which has a pKa of from about 7 to about 14 which is ionizable to an anion and wherein the silver salt of the mercaptan resulting from cleavage or ionization of —SR is more soluble in said aqueous alkaline processing composition in the pH range within which $R_1$ is ionized to an anion than said silver salt is below that pH range, or a precursor, wherein said processing composition initially has a pH substantially equal to or above the pKa of $R_1$ and said means for lowering the pH of an aqueous alkaline processing composition is adapted to lower the pH of said aqueous alkaline processing composition below the pKa of $R_1$.

2. The product as defined in claim 1 wherein the photosensitive element comprises a support carrying a blue-sensitive silver halide emulsion layer having a yellow image dye-providing material associated therewith, a green-sensitive silver halide emulsion layer having a magenta image dye-providing material associated therewith and a red-sensitive silver halide emulsion layer having a cyan image dey-providing material associated therewith.

3. The product as defined in claim 2 wherein said yellow, magenta and cyan image dye-providing materials are initially diffusible.

4. The product as defined in claim 3 wherein said image dye-providing materials are dye developers and said emulsions are negative working emulsions.

5. The product as defined in claim 1 wherein said compound is incorporated in said processing composition.

6. The product as defined in claim 5 wherein said compound is present in an amount of from about 0.02 to about 0.07 percent by weight of said processing composition.

7. The product as defined in claim 1 wherein said second element has a transparent support and includes said means for lowering the pH of an aqueous alkaline processing composition and said image-receiving layer and wherein said processing composition includes a light-reflecting pigment adapted to provide a white background against which an image formed in said image-receiving layer may be viewed through said transparent support.

8. The product as defined in claim 7 wherein said light-reflecting pigment is titanium dioxide.

9. The product as defined in claim 1 wherein R is H.

10. The product as defined in claim 9 wherein $R_1$ is selected from the group consisting of

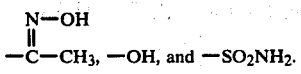

11. The product as defined in claim 1 wherein R is a group which is cleavable in said aqueous alkaline processing composition and said compound is incorporated in said photosensitive element.

12. The product as defined in claim 11 wherein $R_1$ is selected from the group consisting of

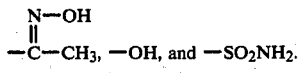

13. The product as defined in claim 1 wherein $R_1$ is a group having a pKa of from about 8.5 to about 13.5.

14. The product as defined in claim 1 wherein said compound is represented by the formula

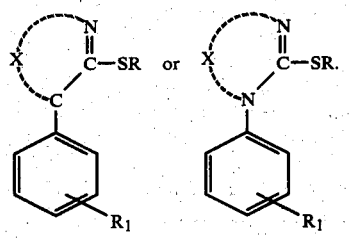

15. The product as defined in claim 1 wherein said compound is represented by the formula

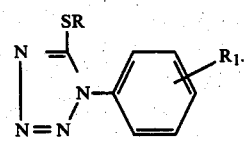

16. The product as defined in claim 15 wherein R is H and $R_1$ is selected from the group consisting of

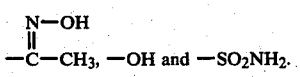

17. The product as defined in claim 16 wherein $R_1$ is —OH.

18. The product as defined in claim 1 wherein said compound is incorporated in said processing composition and in said photosensitive element.

19. The product as defined in claim 18 wherein R is H for said compound incorporated in said processing composition and R is a group which is cleavable in said aqueous alkaline processing composition for said compound which is incorporated in said photosensitive element.

20. A diffusion transfer photographic process comprising exposing a photosensitive element comprising a support carrying at least one silver halide emulsion layer having associated therewith an image dye-providing material, applying an aqueous alkaline processing composition to said exposed photosensitive element to effect development and to form an imagewise distribution of image dye-providing material as a function of development and transferring at least a portion of said imagewise distribution of image dye-providing material to an image receiving layer in superposed or superposable relationship therewith to thereby provide a diffusion transfer image, said development being effected in the presence of at least one compound represented by the formula

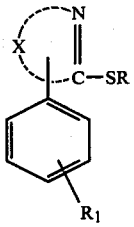

wherein X represents the nonmetallic atoms necessary to form a nucleus which completes a 5- or 6-membered heterocyclic moiety on said structure, R is H, an alkali metal or a group which is cleavable in said photographic aqueous alkaline processing composition; and $R_1$ is a group which has a pKa of from about 7 to about 14 which is ionizable to an anion and wherein the silver salt of the mercaptan resulting from cleavage or ionization of —SR is more soluble in said aqueous alkaline processing composition in the pH range within which $R_1$ is ionized to an anion than said silver salt is below that pH range, or a precursor, wherein said processing composition has a pH substantially equal to or above the pKa of $R_1$ when said composition initially contacts said compound, and subsequently lowering the pH of said aqueous alkaline processing composition below the pKa of $R_1$.

21. The process as defined in claim 20 wherein the photosensitive element comprises a support carrying a blue-sensitive silver halide emulsion layer having a yellow image dye-providing material associated therewith, a green-sensitive silver halide emulsion layer having a magenta image dye-providing material associated therewith and a red-sensitive silver halide emulsion layer having a cyan image dye-providing material associated therewith.

22. The process as defined in claim 20 wherein said yellow, magenta and cyan image dye-providing materials are initially diffusible.

23. The process as defined in claim 22 wherein said image dye-providing materials are dye developers and said emulsions are negative working emulsions.

24. The process as defined in claim 20 wherein said compound is incorporated in said processing composition.

25. The process as defined in claim 24 wherein said compound is present in an amount of from about 0.02 to about 0.07 percent by weight of said processing composition.

26. The process as defined in claim 20 wherein said image-receiving layer is carried by a transparent support which also carries a layer of material for lowering the pH of said processing composition and said processing composition includes a light-reflecting pigment adapted to provide a white background against which the image formed in said image-receiving layer may be viewed through said transparent support.

27. The process as defined in claim 26 wherein said light-reflecting pigment is titanium dioxide.

28. The process as defined in claim 20 wherein R is H.

29. The process as defined in claim 28 wherein $R_1$ is selected from the group consisting of $$-\overset{\overset{\displaystyle N-OH}{\|}}{C}-CH_3,\ -OH \text{ and } -SO_2NH_2.$$

30. The process as defined in claim 20 wherein R is a group which is cleavable in said aqueous alkaline processing composition and said compound is incorporated in said photosensitive element.

31. The process as defined in claim 30 wherein $R_1$ is selected from the group consisting of $$-\overset{\overset{\displaystyle N-OH}{\|}}{C}-CH_3,\ -OH \text{ and } -SO_2NH_2.$$

32. The process as defined in claim 20 wherein $R_1$ is a group having a pKa of from about 8.5 to about 13.5.

33. The process as defined in claim 20 wherein said compound is represented by the formula

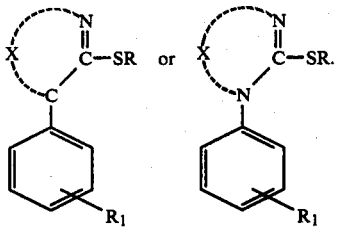

34. The process as defined in claim 20 wherein said compound is represented by the formula

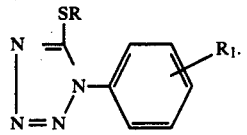

35. The process as defined in claim 34 wherein R is H and $R_1$ is selected from the group consisting of $$-\overset{\overset{\displaystyle N-OH}{\|}}{C}-CH_3,\ -OH, \text{ and } -SO_2NH_2.$$

36. The process as defined in claim 35 wherein $R_1$ is —OH.

37. The process as defined in claim 20 wherein said compound is incorporated in said processing composition and in said photosensitive element.

38. The process as defined in claim 37 wherein R is H for said compound incorporated in said processing composition and R is a group which is cleavable in said aqueous alkaline processing composition for said compound which is incorporated in said photosensitive element.

39. The process as defined in claim 20 wherein said compound is incorporated in said image-receiving layer.

40. The product as defined in claim 1 wherein said compound is incorporated in said image-receiving layer.

* * * * *

UNITED STATES PATENT AND TRADEMARK OFFICE

CERTIFICATE OF CORRECTION

PATENT NO. : 4,390,613

DATED : June 28, 1983

INVENTOR(S) : Avinash C. Mehta et al.

It is certified that error appears in the above-identified patent and that said Letters Patent is hereby corrected as shown below:

The term of this patent subsequent to June 28, 2000 has been disclaimed.

Signed and Sealed this

*Twentieth* Day of *September 1983*

[SEAL]

*Attest:*

GERALD J. MOSSINGHOFF

*Attesting Officer*

*Commissioner of Patents and Trademarks*

UNITED STATES PATENT AND TRADEMARK OFFICE

CERTIFICATE OF CORRECTION

PATENT NO. : 4,390,613

DATED : June 28, 1983

INVENTOR(S) : Avinash C. Mehta; George H. Nawn and Lloyd D. Taylor

It is certified that error appears in the above-identified patent and that said Letters Patent are hereby corrected as shown below:

Column 2, under the formula at lines 52-60, insert ---FORMULA A---.

Column 6, line 9, delete "duel" and insert ---dual---.

Column 15, line 64, delete "acrylamine" and insert ---acrylamide---.

Column 23, in Table VII, at 75°F the Red Dmax for Film Unit VC should be ---1.56---instead of "0.56".

Column 24, line 56, delete "comprises" and insert ---comprised---.

Column 30, line 16, delete "Bis(20 aminoethyl) sulfide" and insert ---Bis(2-aminoethyl)sulfide---.

Column 30, line 65, delete "Table IX" and insert ---Table X---.

Column 31, line 24, delete "VIIC, VIIF and VIIG" and insert ---VIIIC, VIIIF and VIIIG---.

Claim 1, column 32, line 17, delete "an" and insert ---a---.

UNITED STATES PATENT AND TRADEMARK OFFICE

CERTIFICATE OF CORRECTION

PATENT NO. : 4,390,613

DATED : June 28, 1983

INVENTOR(S) : Avinash C. Mehta; George H. Nawn and Lloyd D. Taylor

It is certified that error appears in the above-identified patent and that said Letters Patent are hereby corrected as shown below:

In the Certificate of Correction, dated September 20, 1983, delete "subsequent to June 28, 2000" and insert ---subsequent to October 19, 1999---.

Signed and Sealed this

*Seventeenth* Day of *January 1984*

[SEAL]

*Attest:*

GERALD J. MOSSINGHOFF

*Attesting Officer*

*Commissioner of Patents and Trademarks*